US011227736B2

(12) United States Patent
Sakai et al.

(10) Patent No.: US 11,227,736 B2
(45) **Date of Patent: *Jan. 18, 2022**

(54) ELECTROMAGNETIC DEVICE AND ELECTROMAGNETIC RELAY EQUIPPED WITH ELECTROMAGNETIC DEVICE

(71) Applicant: PANASONIC INTELLECTUAL PROPERTY MANAGEMENT CO., LTD., Osaka (JP)

(72) Inventors: Satoshi Sakai, Mie (JP); Katsuya Uruma, Mie (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 133 days.

This patent is subject to a terminal disclaimer.

(21) Appl. No.: 16/570,278

(22) Filed: Sep. 13, 2019

(65) Prior Publication Data

US 2020/0006025 A1 Jan. 2, 2020

Related U.S. Application Data

(63) Continuation of application No. 15/619,816, filed on Jun. 12, 2017, now Pat. No. 10,446,349.

(51) Int. Cl.
*H01H 9/00* (2006.01)
*H01H 50/20* (2006.01)
(Continued)

(52) U.S. Cl.
CPC ..... *H01H 50/20* (2013.01); *H01H 50/163* (2013.01); *H01H 50/36* (2013.01);
(Continued)

(58) Field of Classification Search
CPC ..... H01H 50/06; H01H 50/08; H01H 50/54; H01H 50/18; H01H 50/20; H01H 50/163;
(Continued)

(56) References Cited

U.S. PATENT DOCUMENTS 4,618,951 A * 10/1986 Okita ..... G11B 17/0284 720/707
4,719,692 A * 1/1988 Sakai ..... G11B 5/4826 29/603.06
(Continued)

FOREIGN PATENT DOCUMENTS

CN 104704596 A 6/2015
JP 11-8116 A 1/1999
(Continued)

*Primary Examiner* — Shawki S Ismail
*Assistant Examiner* — Lisa N Homza
(74) *Attorney, Agent, or Firm* — Greenblum & Bernstein, P.L.C.

(57) ABSTRACT

An electromagnetic device includes a coil, a fixed iron core, a movable iron core configured to reciprocate to separate from the fixed iron core by a predetermined gap when a current applied to the coil is stopped and move to the fixed iron core by an attractive force when the current is applied to the coil, and a permanent magnet. The permanent magnet is arranged so that the permanent magnet is opposed to the gap in a second direction perpendicular to a first direction and separated from the fixed iron core and the movable iron core with a space interposed therebetween. A direction of a second magnetic flux generated by the permanent magnet conforms to a direction of the first magnetic flux between opposed surfaces of the fixed iron core and the movable iron core.

13 Claims, 21 Drawing Sheets

(51) Int. Cl.

| | |
|---|---|
| ***H01H 50/16*** | (2006.01) |
| ***H01H 50/36*** | (2006.01) |
| ***H01H 50/44*** | (2006.01) |
| ***H01H 51/22*** | (2006.01) |
| ***H01H 51/27*** | (2006.01) |

(52) U.S. Cl.
CPC ..... *H01H 50/44* (2013.01); *H01H 51/2209* (2013.01); *H01H 51/27* (2013.01)

(58) Field of Classification Search
CPC ..... H01H 50/36; H01H 50/42; H01H 50/44; H01H 51/22; H01H 51/2209; H01H 51/27; H01H 51/065
USPC ..... 335/179
See application file for complete search history.

(56) References Cited

U.S. PATENT DOCUMENTS

2002/0079005 A1 6/2002 Yoshida
2007/0241847 A1* 10/2007 Yamamoto ..... H01H 50/546 335/196
2008/0073620 A1* 3/2008 Taniguchi ..... C08L 2666/06 252/511
2009/0243771 A1* 10/2009 Uruma ..... H01H 50/04 335/193
2009/0322453 A1* 12/2009 Kawaguchi ..... H01F 7/1615 335/81
2011/0120846 A1* 5/2011 Ito ..... H01H 1/66 200/331
2013/0112669 A1* 5/2013 Uemura ..... H01J 37/32082 219/121.36
2013/0112670 A1* 5/2013 Yokogawa ..... H01J 37/32522 219/121.36
2015/0194284 A1* 7/2015 Uruma ..... H01H 9/443 335/179
2015/0213985 A1 7/2015 Naka et al.
2016/0300676 A1* 10/2016 Sakai ..... H01H 50/546
2016/0300680 A1* 10/2016 Yokoyama ..... H01H 1/22
2017/0365431 A1* 12/2017 Sakai ..... H01H 51/065
2017/0365432 A1* 12/2017 Sakai ..... H01H 50/44
2018/0061599 A1* 3/2018 Enomoto ..... H01H 1/0015

FOREIGN PATENT DOCUMENTS

JP 2002-188743 A 7/2002
JP 2010-10058 1/2010

* cited by examiner

ELECTROMAGNETIC DEVICE AND ELECTROMAGNETIC RELAY EQUIPPED WITH ELECTROMAGNETIC DEVICE

CROSS REFERENCE TO RELATED APPLICATIONS

This is a Continuation Application of U.S. patent application Ser. No. 15/619,816, filed Jun. 12, 2017 which claims priority to Japanese Patent Application No. 2016-120961 filed on Jun. 17, 2016 and Japanese Patent Application No. 2016-254021 filed on Dec. 27, 2016. The disclosures of the above-mentioned documents are incorporated by reference herein in their entireties.

BACKGROUND OF THE INVENTION

The present invention relates to an electromagnetic device and an electromagnetic relay equipped with the electromagnetic device.

JP 2010-010058 (hereinafter, referred to as Patent Literature 1) discloses an electromagnetic device including a coil which generates a magnetic flux when a current is applied, a fixed member through which the generated magnetic flux flows, and a movable member which reciprocates to separate from the fixed member by a predetermined gap when the current applied to the coil is stopped and move to the fixed member by an attractive force when the current is applied to the coil.

The movable member in Patent Literature 1 can be driven with smaller power consumption by use of a magnetic force of a permanent magnet provided in the movable member.

In the electromagnetic device disclosed in Patent Literature 1, the amount of the magnetic flux generated by the permanent magnet and flowing through the opposed surface (the magnetic pole face) of the movable member opposed to the fixed member tends to decrease, since the permanent magnet is located in the middle of the movable member in the reciprocation direction. Namely, the magnetic flux generated by the permanent magnet contributing to improving the attractive force acting on the movable member for moving toward the fixed member is reduced.

Since the conventional technology cannot allow the magnetic flux generated by the permanent magnet to efficiently flow through the magnetic pole face, there remains a need for improvement in the attractive force acting on the movable member for moving toward the fixed member.

SUMMARY OF THE INVENTION

An object of the present invention is to provide an electromagnetic device with improved attractive force acting on a movable member for moving toward a fixed member, and an electromagnetic relay equipped with the electromagnetic device.

An electromagnetic device according to the present invention includes: a coil configured to generate a first magnetic flux when a current is applied thereto; a fixed member through which the first magnetic flux flows; a movable member configured to reciprocate to separate from the fixed member by a predetermined gap when the current applied to the coil is stopped and move to the fixed member by an attractive force when the current is applied to the coil; and a permanent magnet configured to generate a second magnetic flux.

The permanent magnet is arranged at a position adjacent to the gap and separated from the fixed member and the movable member with a space interposed therebetween.

A direction of the second magnetic flux conforms to a direction of the first magnetic flux between opposed surfaces of the fixed member and the movable member.

An electromagnetic relay according to the present invention is equipped with the electromagnetic device.

DESCRIPTION OF THE EMBODIMENTS

Figure 1:
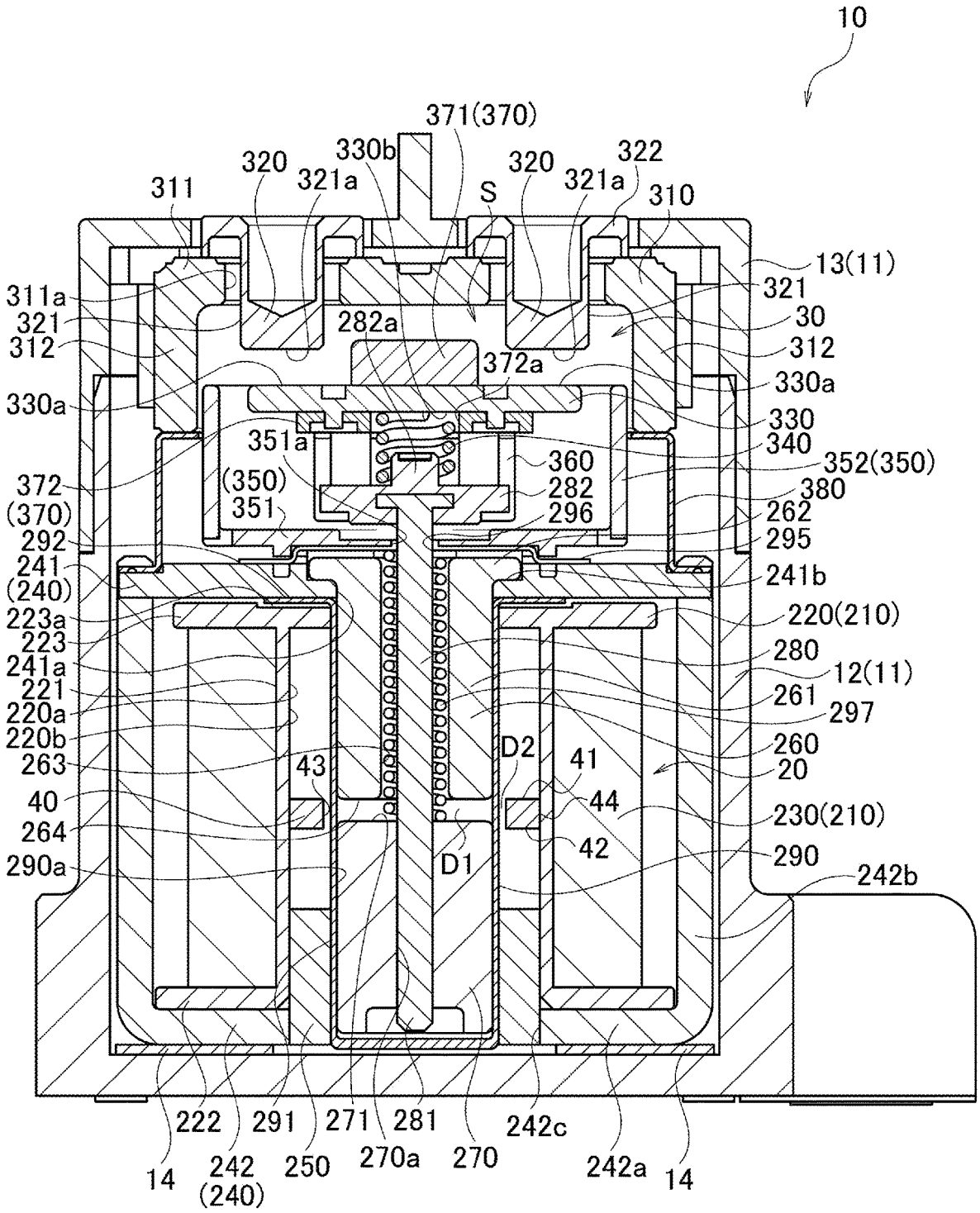
FIG. 1 is a cross-sectional view of an electromagnetic relay according to a first embodiment of the present invention.

Hereinafter, embodiments of the present invention will be described with reference to the drawings. As used herein, the definitions of the top, bottom, right, and left applied to FIG. 1 are used for the explanations of the drawings throughout the Specification. The direction perpendicular to the paper of FIG. 1 is referred to as a front-rear direction.

The following embodiments include the similar elements. The similar elements are designated by the common reference numerals, and overlapping explanations thereof are not repeated below.

First Embodiment

An electromagnetic relay 10 according to the present embodiment is of a normally open type in which contact points are OFF in an initial state. As shown in FIG. 1, the electromagnetic relay 10 includes an electromagnetic device 20 located on the lower side and a contact device 30 located on the upper side. The electromagnetic device 20 and the contact device 30 are housed in a case 11 formed into a hollow box shape and made of a polymer material. An electromagnetic relay of a normally closed type in which contact points are ON in the initial state may be used instead.

The case 11 includes a substantially box-shaped case body 12 open on the upper side, and a case cover 13 covering the opening of the case body 12. The electromagnetic device 20 and the contact device 30 are housed in the inside space of the case 11 with the case body 12 covered with the case cover 13. In the present embodiment, a damper rubber 14 made of an elastic rubber material is placed on the bottom of the case body 12. The electromagnetic device 20 is installed on the bottom of the case body 12 with the damper rubber 14 interposed therebetween.

Figure 2:
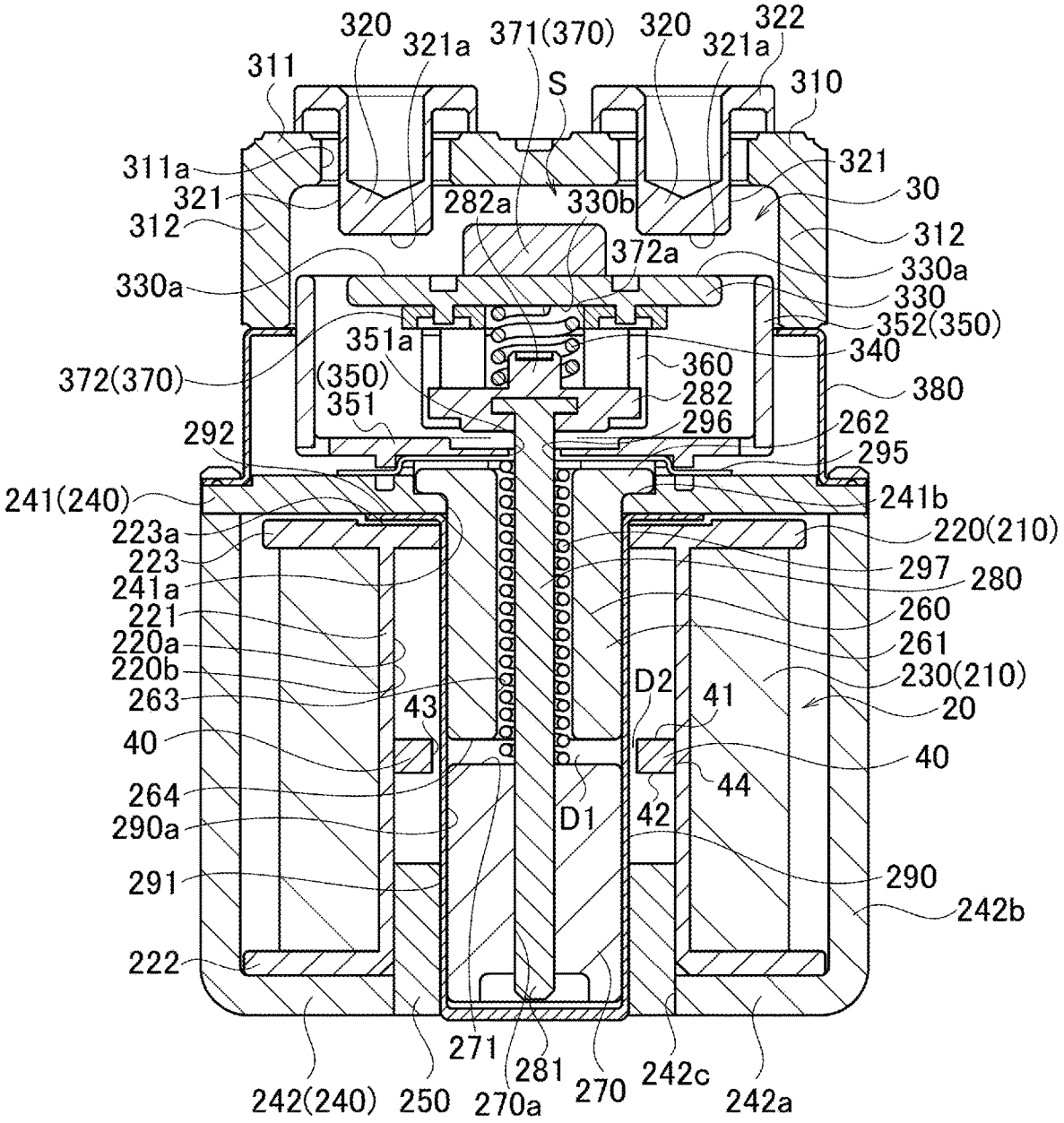
FIG. 2 is a cross-sectional view of a contact device and an electromagnetic device according to the first embodiment of the present invention.
Figure 4:
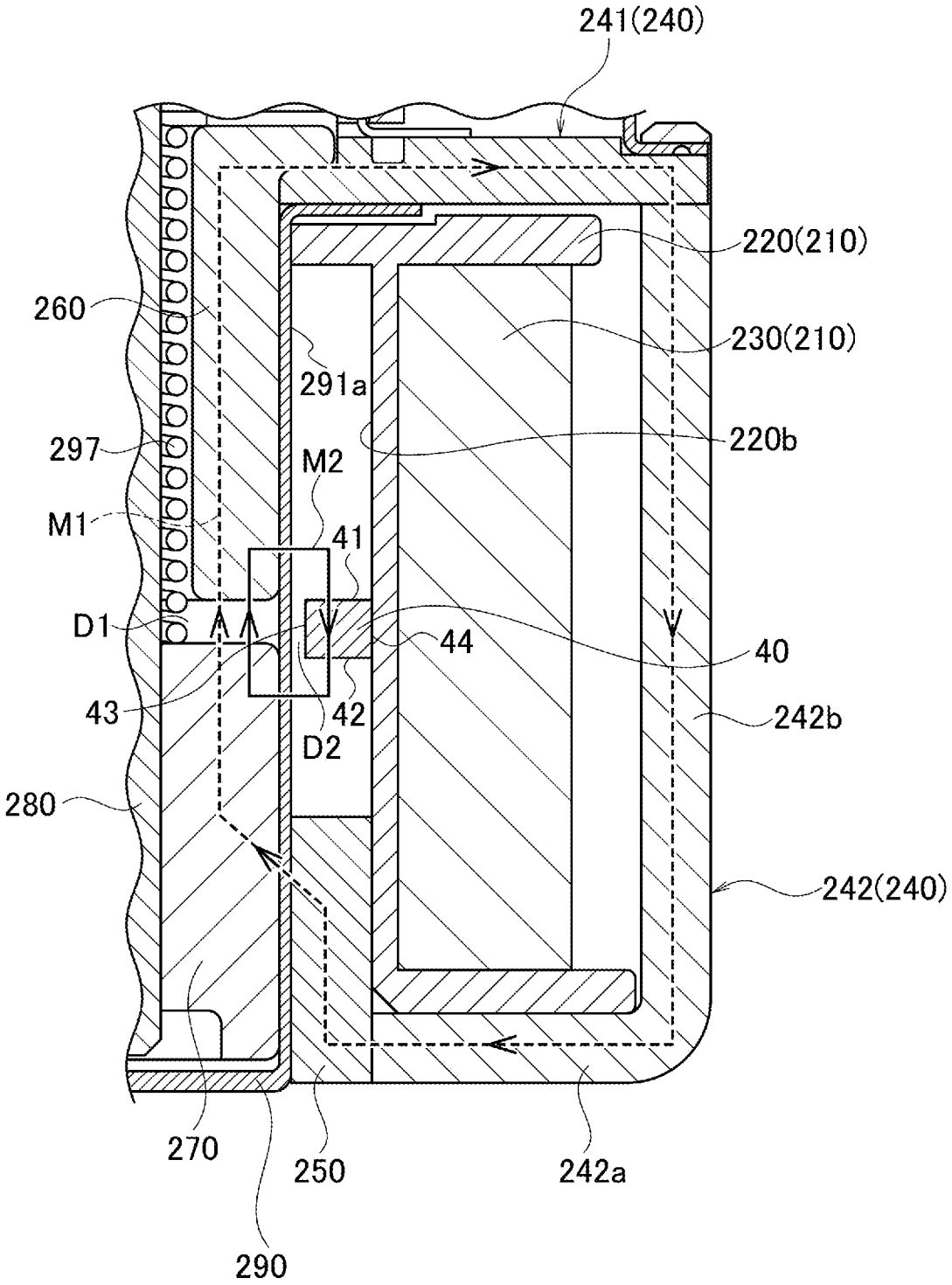
FIG. 4 is a view for schematically illustrating a flow of a magnetic flux generated in the electromagnetic relay according to the first embodiment of the present invention.

The electromagnetic device 20 includes a coil unit 210. The coil unit 210 includes a coil 230 which generates first magnetic flux M1 when a current is applied thereto, and a cylindrical hollow coil bobbin 220 on which the coil 230 is wound, as shown in FIG. 2 and FIG. 4.

Although not illustrated in the drawings, a pair of coil terminals is fixed to the coil bobbin 220 and connected with both ends of the coil 230. The electromagnetic device 20 is driven when the current is applied to the coil 230 through the pair of coil terminals. The driven electromagnetic device 20 operates to open and close fixed contact points 321*a* and movable contact points 330*a* of the contact device 30, as described below, so as to switch the electrical connection between a pair of fixed terminals 320.

The coil bobbin 220 is made of an insulating resin material and provided with an insertion hole 220*a* penetrating the middle of the coil bobbin 220 in the vertical direction. The coil bobbin 220 includes a wound body 221 having a substantially cylindrical shape on which the coil 230 is wound around the outer surface, a lower flange 222 having a substantially circular shape integrated with the bottom of the wound body 221 and extending outward in the radial direction of the wound body 221, and an upper flange 223 having a substantially circular shape integrated with the top of the wound body 221 and extending outward in the radial direction of the wound body 221. In the present embodiment, the upper flange 223 also protrudes inward in the radial direction of the wound body 221. The diameter of the opening of the insertion hole 220*a* is smaller on the upper side than on the lower side.

The electromagnetic device 20 further includes a yoke 240 placed around the coil 230. The yoke 240 is made of a magnetic material and surrounds the coil bobbin 220. In the present embodiment, the yoke 240 includes a rectangular yoke upper plate 241 located on the upper surface of the coil bobbin 220, and a rectangular yoke 242 located on the lower surface and the side surface of the coil bobbin 220.

The yoke 242 is located between the coil 230 and the case 11. The yoke 242 includes a bottom wall 242*a* and a pair of side walls 242*b* extending upward from the right and left edges (circumferential edges) of the bottom wall 242*a*, and is open in the front-rear direction. The bottom wall 242*a* and the pair of the side walls 242*b* may be integrated and formed such that a single plate is bent. The bottom wall 242*a* of the yoke 242 is provided with a circular insertion hole 242*c* into which a bushing 250 made of a magnetic material is inserted.

The yoke upper plate 241 is placed on the end side (on the upper side) of the pair of the side walls 242*b* of the yoke 242 to cover the upper surface of the coil bobbin 220 and the coil 230 wound on the coil bobbin 220.

The electromagnetic device 20 includes a fixed iron core (a fixed member) 260 which is placed in the cylindrical inner portion (in the insertion hole 220*a*) of the coil bobbin 220 and magnetized by the coil 230 applied with the current (allows the first magnetic flux M1 to flow therethrough), and a movable iron core (a movable member) 270 which is opposed to the fixed iron core 260 in the vertical direction (in the shaft direction) and placed in the cylindrical inner portion (in the insertion hole 220*a*) of the coil bobbin 220.

The fixed iron core 260 includes a cylinder portion 261 inserted into the cylindrical inner portion (in the insertion hole 220*a*) of the coil bobbin 220, and a flange 262 extending outward in the radial direction from the upper end of the cylinder portion 261. The fixed iron core 260 is provided with an insertion hole 263 into which a shaft (a drive shaft) 280 and a return spring 297 are inserted. The movable iron core 270 is provided with an insertion hole 270*a* in which the shaft (the drive shaft) 280 is inserted and fixed.

The shaft 280 is made of a nonmagnetic material, and includes a shaft body 281 having a round rod shape elongated in the moving direction of the movable iron core 270 (in the vertical direction: the drive-shaft direction) and a flange 282 having a substantially circular shape and extending outward in the radial direction from the upper end of the shaft body 281.

The bottom end of the shaft body 281 is inserted from the top of the insertion hole 270*a* of the movable iron core 270 so that the shaft 280 is connected to the movable iron core 270.

The electromagnetic device 20 includes a plunger cap 290 made of a nonmagnetic material and having a bottomed cylindrical shape open on the upper side. The plunger cap 290 is placed between the fixed iron core 260 and the coil bobbin 220 and between the movable iron core 270 and the coil bobbin 220.

The plunger cap 290 includes a body 291 having a bottomed cylindrical shape open on the upper side, and a flange 292 having a substantially circular shape and extending outward in the radial direction from the upper end of the body 291. The body 291 of the plunger cap 290 is inserted into the insertion hole 220*a* located in the middle of the coil bobbin 220. A circular setting surface 223*a* is provided on the upper side of the coil bobbin 220 (on the upper flange 223) on which the flange 292 of the plunger cap 290 is placed.

The cylinder portion 261 of the fixed iron core 260 and the movable iron core 270 are housed in a housing space 290*a* of the plunger cap 290 placed in the cylindrical inner portion (in the insertion hole 220*a*) of the coil bobbin 220. The fixed iron core 260 is located on the opening side of the plunger cap 290, and the movable iron core 270 is located below the fixed iron core 260 inside the cylindrical plunger cap 290.

The cylinder portion 261 of the fixed iron core 260 and the movable iron core 270 are each formed into a cylindrical shape having an outer diameter which is substantially the same as the inner diameter of the plunger cap 290. The movable iron core 270 slides along the inside of the housing space 290*a* of the plunger cap 290 in the vertical direction (in the reciprocating direction: the drive-shaft direction).

In the present embodiment, the flange 292 located on the opening side of the plunger cap 290 is fixed to the periphery of an insertion hole 241*a* on the lower surface of the yoke upper plate 241. The lower bottom of the plunger cap 290 is inserted into the bushing 250 placed in the insertion hole 242*c* of the bottom wall 242*a*.

The movable iron core 270 placed on the bottom of the plunger cap 290 is magnetically connected to the periphery of the bushing 250. In other words, the bushing 250 composes a magnetic circuit together with the yoke 240 (the yoke upper plate 241 and the yoke 242), the fixed iron core 260, and the movable iron core 270.

The yoke upper plate 241 is provided in the middle with the insertion hole 241*a* into which the fixed iron core 260 is inserted. The cylinder portion 261 of the fixed iron core 260 is inserted into the insertion hole 241*a* from the upper side of the yoke upper plate 241. The yoke upper plate 241 is provided, substantially in the middle on the upper surface, with a recess 241*b* having substantially the same diameter as the flange 262 of the fixed iron core 260 to prevent the flange 262 fitted to the recess 241*b* from falling off.

A holding plate 295 made of metal is placed on the yoke upper plate 241 with right and left edges fixed to the upper surface of the yoke upper plate 241. The holding plate 295 is provided with a protrusion in the middle protruding above the upper surface of the yoke upper plate 241 so as to define the space for housing the flange 262 of the fixed iron core 260.

The holding plate 295 is provided with an insertion hole 296 into which the shaft 280 is inserted. The upper end of the shaft 280 (on the flange 282 side) extends to the contact device 30 through the insertion hole 263 of the fixed iron core 260 and the insertion hole 296 of the holding plate 295.

When the current is applied to the coil 230, the attractive force acts on the movable iron core 270 so that the movable iron core 270 moves upward to the fixed iron core 260. The shaft 280 connected and fixed to the movable iron core 270 moves upward together.

The range of movement of the movable iron core 270 is between the initial position at which the movable iron core 270 is separated from and located below the fixed iron core 260 with the gap D1 provided therebetween (the position the most distant from the fixed iron core 260) and the contact position at which the movable iron core 270 is brought into contact with the fixed iron core 260 (the position the closest to the fixed iron core 260).

The return spring 297 is placed between the movable iron core 270 and the holding plate 295 to bias the movable iron core 270 by the elastic force in the direction in which the movable iron core 270 returns to the initial position (in the direction away from the fixed iron core 260). In the present embodiment, the return spring 297 is a coil spring wound on the shaft 280 and placed inside the insertion hole 263 of the fixed iron core 260.

This configuration leads the opposed surface 264 of the fixed iron core 260 opposed to the movable iron core 270 and the opposed surface 271 of the movable iron core 270 opposed to the fixed iron core 260, which are a pair of magnetic poles, to heteropolarity when the current is applied to the coil 230, so that the movable iron core 270 moves to the contact position by the attractive force. Thus, in the present embodiment, the pair of the opposed surface 264 of the fixed iron core 260 and the opposed surface 271 of the movable iron core 270 function as magnetic pole faces when the current is applied to the coil 230.

When the current applied to the coil 230 is stopped, the movable iron core 270 returns to the initial position due to the biasing force of the return spring 297.

The movable iron core 270 according to the present embodiment reciprocates to separate from the fixed iron core 260 by the gap D1 when the current applied to the coil 230 is stopped and move to the fixed member 260 by the attractive force when the current is applied to the coil 230.

The contact device 30 is located above the electromagnetic device 20, and opens and closes the contact points depending on the ON/OFF operation for the application of the current to the coil 230.

The contact device 30 includes a box-shaped base 310 made of a heat resistant material such as a ceramic material and open on the lower side. The base 310 includes a ceiling 311 and a circumferential wall 312 having a substantially square column shape extending downward from the circumference of the ceiling 311.

The ceiling 311 of the base 30 is provided with two insertion holes 311*a* into which the fixed terminals 320 are inserted. The pair of (plurality of) the fixed terminals 320 is made of an electrically conductive material such as a copper material. Each of the fixed terminals 320 includes a fixed terminal body 321 having a substantially columnar shape inserted into the insertion hole 311*a* from above, and a flange 322 having a substantially disk-like shape extending outward in the radial direction from the upper end of the fixed terminal body 321 and fixed to the upper surface of the ceiling 311 (the upper surface of the circumference of the insertion hole 311*a*). The fixed contact points 321*a* are located on the bottom surfaces of the fixed contact bodies 321.

Although not shown in the drawings, a pair of terminals connected to an external load and the like is attached to the pair of the fixed terminals 320. The pair of terminals may be made of an electrically conductive material and formed into a plate shape.

The base 310 houses a movable contact 330 elongated across the pair of the fixed contact points 321*a* and including movable contact points 330*a* located on the upper surface of the movable contact 330 to face the respective fixed contact points 321*a*. Although the present embodiment exemplifies the case in which the movable contact points 330*a* are integrated with the movable contact 330, the movable contact points 330*a* may be provided separately from the movable contact 330.

The movable contact 330 is attached to the shaft (the drive shaft) 280 such that the movable contact points 330*a* are separated from and opposed to the fixed contact points 321*a* with a predetermined gap provided therebetween when the current is not applied to the coil 230. When the current is applied to the coil 230, the movable contact 330 moves upward together with the movable iron core 270 and the shaft 280, so that the movable contact points 330*a* come into contact with the fixed contact points 321*a*.

In the present embodiment, the movable iron core 270 and the movable contact 330 are arranged such that the movable contact points 330*a* and the fixed contact points 321*a* are separated from each other when the movable iron core 270 is located in the initial position and come into contact with each other when the movable iron core 270 is located in the contact position. Accordingly, the fixed terminals 320 are electrically isolated from each other when the contact device 30 is turned off during the non-conducting state of the coil 230 and electrically connected to each other when the contact device 30 is turned on during the application of the current to the coil 230.

The shaft (the drive shaft) 280 is attached to the middle of the movable contact 330 via a holder 360.

In the present embodiment, a yoke 370 is provided on the movable contact 330 so as to prevent contact welding caused by an electric arc.

More particularly, the yoke 370 includes an upper yoke (a first yoke) 371 located on the upper side of the movable contact 330 and a lower yoke (a second yoke) 372 located on the lower side of the movable contact 330.

The contact pressure between the movable contact points 330*a* and the fixed contact points 321*a* is ensured due to a pressure spring 340.

The pressure spring 340 is a coil spring of which the axial direction is parallel to the vertical direction.

The pressure spring 340 is arranged such that the upper end is inserted into an insertion hole 372*a* provided in the lower yoke (the second yoke) 372 and the lower end is fitted to a spring receiver 282*a* provided in the flange 282. The movable contact 330 is biased upward by the pressure spring 340.

The upper end of the pressure spring 340 is in contact with the lower surface 330*b* of the movable contact 330. According to the present embodiment, since the pressure spring 340 biases the movable contact 330 upward in the drive shaft direction without contact with the lower yoke 372 (the yoke 370) (without the yoke interposed therebetween), a reduction in size of the electromagnetic relay 10 (the electromagnetic device 20 and the contact device 30) in the height direction (in the vertical direction: the drive-shaft direction) can be achieved.

Further, in the present embodiment, gas is sealed in the base 310 in order to prevent the occurrence of an electric arc between the movable contact points 330*a* and the fixed contact points 321*a* when the movable contact points 330*a* are separated from the fixed contact points 321*a*. The gas used may be mixed gas mainly including hydrogen gas superior in heat conductivity in the temperature range in which an electric arc occurs. In the present embodiment, an upper flange 380 covering the gap between the base 310 and the yoke upper plate 241 is provided so as to seal the gas.

More particularly, the base 310 includes the ceiling 311 provided with the pair of the aligned insertion holes 311*a* and the circumferential wall 312 having a square column shape extending downward from the circumference of the ceiling 311, and is formed into a hollow box shape open on the lower side (on the movable contact 330 side), as described above. The base 310 is fixed to the yoke upper plate 241 via the upper flange 380 with the movable contact 330 housed inside the circumferential wall 312 from the opening on the lower side.

The circumference of the opening on the lower side of the base 310 is preferably airtightly connected to the upper surface of the upper flange 380 by silver brazing. In addition, the lower surface of the upper flange 380 is preferably airtightly connected to the upper surface of the yoke upper plate 241 by arc welding or the like. Further, the lower surface of the yoke upper plate 241 is preferably airtightly connected to the flange 292 of the plunger cap 290 by arc welding or the like. Accordingly, the seal space S for sealing the gas can be provided in the base 310.

A capsule yoke block is preferably used in addition to the gas in order to prevent the occurrence of an electric arc. The capsule yoke block may be composed of a capsule yoke having a substantially U-shape and made of a magnetic material such as iron, and a pair of permanent magnets.

An insulating member 350 is also provided in the opening of the base 310 in order to insulate the connected portion between the base 310 and the upper flange 380 against an electric arc caused between the fixed contact points 321*a* and the movable contact points 330*a*.

The insulating member 350 has a substantially rectangular cuboid open on the upper side and made of an insulating material such as a ceramic material and synthetic resin, and includes a bottom wall 351 and a circumferential wall 352 extending upward from the circumference of the bottom wall 351. The upper end of the upper flange 380 is brought into contact with the circumferential wall 352 on the upper side. The insulating member 350 thus insulates the connected portion between the base 310 and the upper flange 380 from the contact points of the fixed contact points 321*a* and the movable contact points 330*a*.

The bottom wall 351 of the insulating member 350 is provided with an insertion hole 351*a* into which the shaft 280 is inserted.

Next, the operation of the electromagnetic relay 10 (the electromagnetic device 20 and the contact device 30) is described below.

When the current applied to the coil 230 is stopped, the movable iron core 270 moves in the direction away from the fixed iron core 260 due to the elastic force of the return spring 297, so that the movable contact points 330*a* are separated from the fixed contact points 321*a*, as shown in FIG. 1 and FIG. 2.

When the coil 230 is switched from the off state to the conducting state, the movable iron core 270 moves upward (toward the fixed iron core 260) due to the electromagnetic force and comes closer to the fixed iron core 260 against the elastic force of the return spring 297. In association with the upward movement of the movable iron core 270 (toward the fixed iron core 260), the shaft 280, and the upper yoke 371, the movable contact 330, the lower yoke 372 and the holder 360 attached to the shaft 280 move upward (toward the fixed contact points 321*a*). As a result, the movable contact points 330*a* of the movable contact 330 are brought into contact with and electrically connected to the fixed contact points 321*a* of the fixed terminals 320, so that the electromagnetic relay 10 (the electromagnetic device 20 and the contact device 30) is turned on.

The electromagnetic relay 10 according to the present embodiment improves the attractive force acting on the movable iron core (the movable member) 270 for moving toward the fixed iron core (the fixed member) 260.

In particular, a permanent magnet 40 for generating second magnetic flux M2 is used to improve the attractive force acting on the movable iron core 270 for moving toward the fixed iron core 260.

Figure 3:
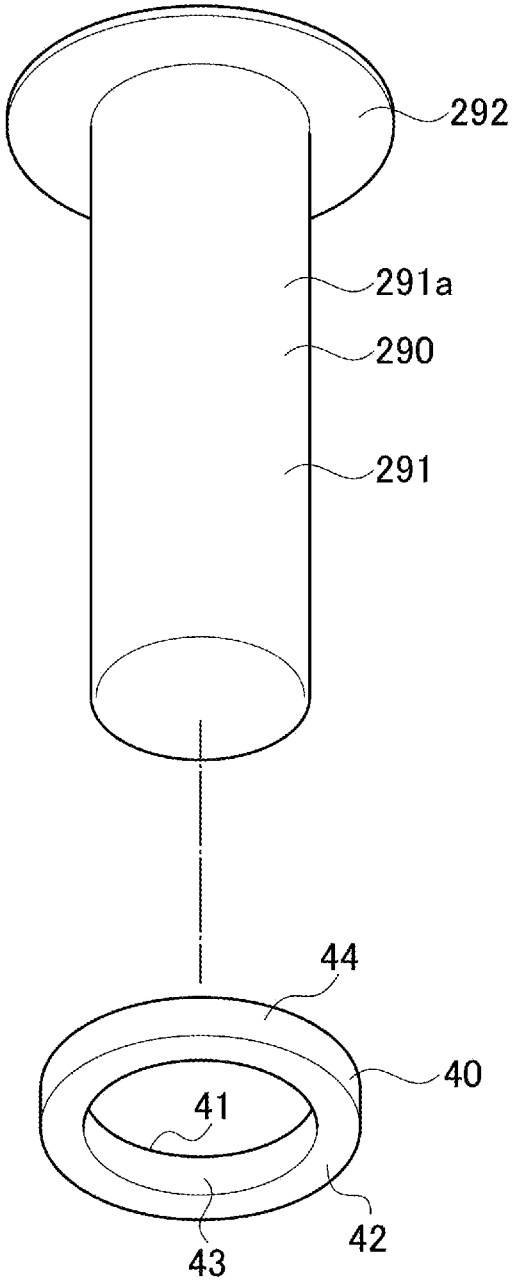
FIG. 3 is a perspective view of a plunger cap and a permanent magnet according to the first embodiment of the present invention.

The present embodiment uses the circular (ring-shaped) permanent magnet 40 having a rectangular shape in cross section, as shown in FIG. 2 and FIG. 3. The permanent magnet 40 has an upper surface 41 and a lower surface 42 serving as magnetized surfaces with the penetration direction conforming to the vertical direction. FIG. 4 illustrates the permanent magnet 40 arranged in the state in which the upper surface 41 serves as the S-pole and the lower surface 42 serves as the N-pole.

The circular permanent magnet 40 is placed inside the insertion hole 220*a* of the coil bobbin 220 such that the inner surface 43 is opposed to the outer surface 291*a* of the body 291 of the plunger cap 290 with a gap provided therebetween, as shown in FIG. 2 and FIG. 4. In the present embodiment, the outer surface 44 of the permanent magnet 40 is in contact with the inner surface 220*b* of the insertion hole 220*a*. The permanent magnet 40 may be fixed to the insertion hole 220*a* by any conventional method such as fitting and adhesion.

In the present embodiment, the permanent magnet 40 is located adjacent to the gap D1 between the opposed surface 264 of the fixed iron core 260 opposed to the movable iron core 270 and the opposed surface 271 of the movable iron core 270 opposed to the fixed iron core 260 when the current is not applied to the coil 230.

More particularly, the permanent magnet 40 is arranged such that the inner surface 43 surrounds the entire circumference of the gap D1. In other words, as viewed in the vertical direction (the reciprocating direction: the drive-shaft direction), the inner surface 43 of the permanent magnet 40 has a circular shape surrounding the circle defined by the outer surface of the iron core (the fixed iron core 260 or the movable iron core 270) substantially corresponding to the boundary of the gap D1.

In the present embodiment, the thickness of the permanent magnet 40 is greater than the gap D1. The permanent magnet 40 therefore overlaps with at least one of the fixed iron core 260 and the movable iron core 270, as viewed in the radial direction (in the direction perpendicular to the reciprocating direction of the movable iron core 270). As shown in FIG. 4, the permanent magnet 40 is arranged such that the lower surface 42 is located below the opposed surface 271 of the movable iron core 270 and the upper surface 41 is located at substantially the same height as the opposed surface 264 of the fixed iron core 260. As viewed in the radial direction (in the direction perpendicular to the reciprocating direction of the movable iron core 270), the substantially entire boundary of the gap D1 (the cylindrical surface between the outer circumference of the opposed surface 264 and the outer circumference of the opposed surface 271) is covered with the permanent magnet 40 while the permanent magnet 40 overlaps with the movable iron core 270.

As described above, the permanent magnet 40 of the present embodiment is arranged such that the inner surface 43 is opposed to the gap D1 in the radial direction.

The permanent magnet 40 may also overlap with the fixed iron core 260 so that the entire boundary of the gap D1 is covered with the permanent magnet 40, as viewed in the radial direction, or there may be a part not covered with the permanent magnet 40 in either the fixed iron core 260 or the movable iron core 270.

Alternatively, the permanent magnet 40 may overlap with neither the fixed iron core 260 nor the movable iron core 270 so that the inner surface 43 is entirely opposed to the gap D1 in the radial direction.

The permanent magnet 40 is separated from the fixed iron core 260 and the movable iron core 270 with the space D2 interposed therebetween. The size of the space D2 (the distance in the radial direction) is the sum of the gap (the distance in the radial direction) between the inner surface 43 of the permanent magnet 40 and the outer surface 291*a* and the thickness of the body 291.

This arrangement of the permanent magnet 40 leads the direction in which the paired magnetized surfaces (the upper surface 41 and the lower surface 42) of the permanent magnet 40 are opposed into conforming to the vertical direction (the reciprocating direction of the movable iron core 270).

Namely, the normal direction of the pair of magnetized surfaces (the upper surface 41 and the lower surface 42) of the permanent magnet 40 corresponds to the vertical direction (the reciprocating direction of the movable iron core 270).

In the present embodiment, the direction of the second magnetic flux M2 between the opposed surfaces (the opposed surface 264 and the opposed surface 271) of the fixed iron core 260 and the movable iron core 270 conforms to the direction of the first magnetic flux M1 between the opposed surfaces (the opposed surface 264 and the opposed surface 271) of the fixed iron core 260 and the movable iron core 270 (in FIG. 4, the upward direction).

As described above, the permanent magnet 40 of the present embodiment is arranged around the opposed surfaces (the opposed surface 264 and the opposed surface 271) of the fixed iron core 260 and the movable iron core 270 such that the direction of the second magnetic flux M2 conforms to the direction of the first magnetic flux M1 between the opposed surfaces. As compared with the case shown in FIG. 5, the present embodiment can allow the magnetic flux (the second magnetic flux M2) generated by the permanent magnet 40 to efficiently flow through the opposed surfaces, as shown in FIG. 4.

Figure 5:
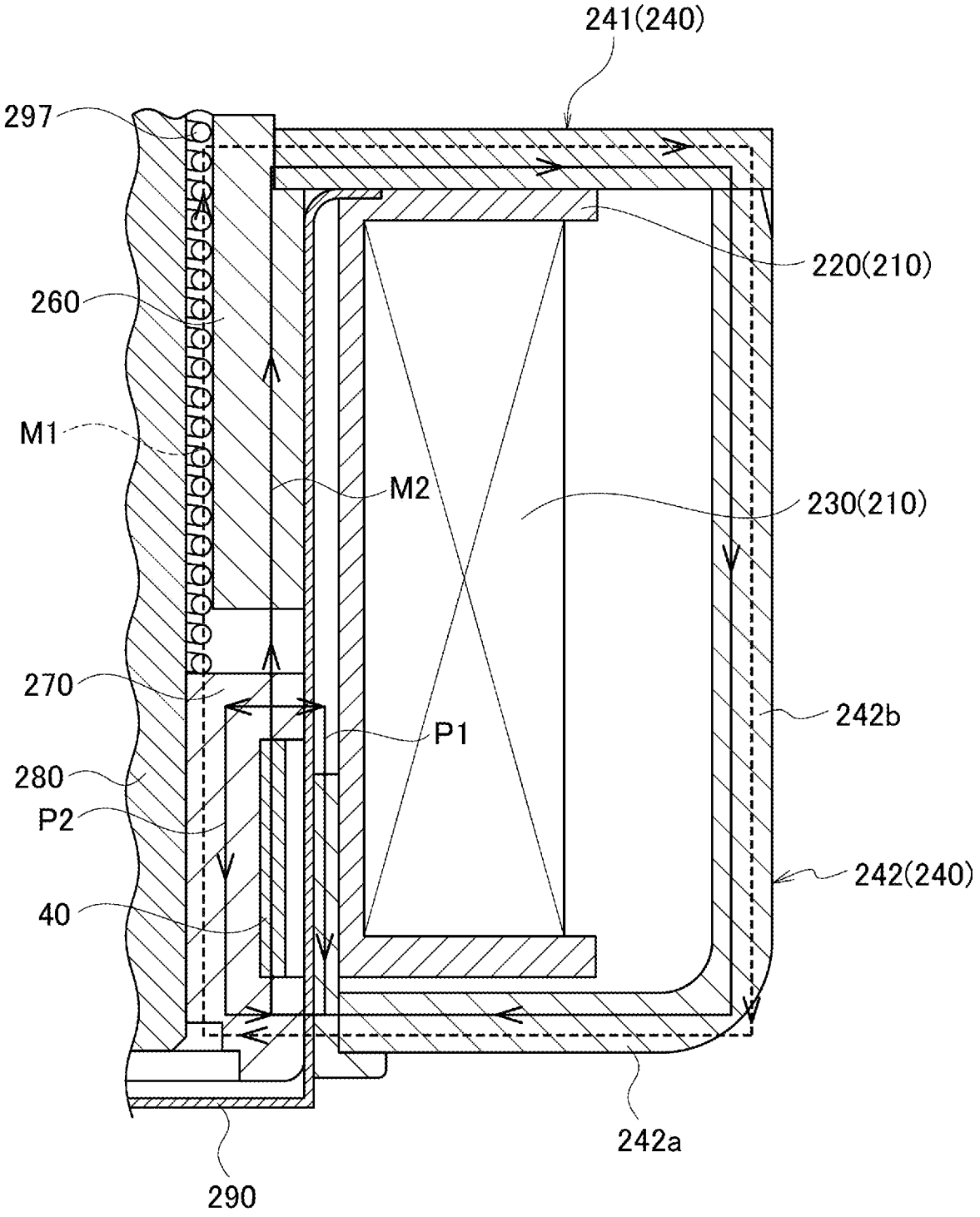
FIG. 5 is a view for schematically illustrating a flow of a magnetic flux generated in an electromagnetic relay according to a comparative example.

FIG. 5 illustrates the structure in which the permanent magnet 40 is arranged on the outer side in the middle of the movable iron core 270 in the vertical direction (in the reciprocating direction of the movable iron core 270). This structure results in two routes, as described below, through which the magnetic flux (the second magnetic flux M2) generated by the permanent magnet 40 flows, since the permanent magnet 40 is not exposed to the opposed surface 264 of the fixed iron core 260.

As shown in FIG. 5, the first route P1 makes a loop passing through the upper portion of the permanent magnet 40, the outer upper portion of the movable iron core 270, the upper portion of the bushing 250, the lower portion of the bushing 250, the outer lower portion of the movable iron core 270, and the lower portion of the permanent magnet 40, and returning to the upper portion of the permanent magnet 40.

The second route P2 makes a loop passing through the upper portion of the permanent magnet 40, the outer upper portion of the movable iron core 270, the inner upper portion of the movable iron core 270, the inner lower portion of the movable iron core 270, the outer lower portion of the movable iron core 270, and the lower portion of the permanent magnet 40, and returning to the upper portion of the permanent magnet 40.

Since the first route P1 or the second route P2 does not pass across the opposed surfaces (the opposed surface 264 and the opposed surface 271), the amount of the magnetic flux (the second magnetic flux M2) generated by the permanent magnet 40 and flowing through the opposed surfaces (the opposed surface 264 and the opposed surface 271) tends to decrease. Namely, the magnetic flux (the second magnetic flux M2) generated by the permanent magnet 40 contributing to improving the attractive force acting on the movable iron core 270 for moving toward the fixed iron core 260 is reduced.

In the present embodiment, as shown in FIG. 4, the magnetic flux (the second magnetic flux M2) generated by the permanent magnet 40 and passing along the route at least on the iron core side flows through the opposed surfaces (the opposed surface 264 and the opposed surface 271). Accordingly, the efficiency of the magnetic flux (the second magnetic flux M2) generated by the permanent magnet 40 and flowing through the opposed surfaces can be improved, so as to increase the amount of the magnetic flux contributing to improving the attractive force acting on the movable iron core 270 for moving toward the fixed iron core 260.

As described above, the electromagnetic device 20 according to the present embodiment includes the coil 230 which generates the first magnetic flux M1 when a current is applied thereto, the fixed iron core (the fixed member) 260 through which the first magnetic flux M1 flows, the movable iron core (the movable member) 270 which reciprocates to separate from the fixed iron core 260 by the gap D1 when the current applied to the coil 230 is stopped and move to the fixed member 260 by the attractive force when the current is applied to the coil 230, and the permanent magnet 40 which generates the second magnetic flux M2.

The permanent magnet 40 is arranged adjacent to the gap D1 and separated from the fixed iron core 260 and the movable iron core 270 with the space D2 interposed therebetween.

The direction of the second magnetic flux M2 conforms to the direction of the first magnetic flux M1 between the opposed surfaces of the fixed iron core 260 and the movable iron core 270.

Accordingly, the efficiency of the magnetic flux (the second magnetic flux M2) generated by the permanent magnet 40 and flowing through the opposed surfaces can be improved, so as to increase the attractive force acting on the movable iron core (the movable member) 270 for moving toward the fixed iron core (the fixed member) 260.

In the present embodiment, the permanent magnet 40 is arranged such that the normal direction of at least one of the pair of magnetized surfaces (at least one of the upper surface 41 and the lower surface 42) corresponds to the vertical direction (the reciprocating direction of the movable iron core 270).

Accordingly, the flowing direction of the magnetic flux (the second magnetic flux M2) adjacent to the magnetized surfaces is substantially parallel to the vertical direction (the reciprocating direction of the movable iron core 270). The flowing direction of the second magnetic flux M2 corresponds to the vertical direction (the reciprocating direction of the movable iron core 270) in the range from one magnetized surface to the other magnetized surface. Since the flowing direction of the second magnetic flux M2 flowing through the opposed surfaces substantially conforms to the vertical direction (the reciprocating direction of the movable iron core 270), the attractive force acting on the movable iron core 270 for moving toward the fixed iron core 260 can be improved.

Further, in the present embodiment, since the normal direction of both of the pair of magnetized surfaces corresponds to the vertical direction (the reciprocating direction of the movable iron core 270), the flowing direction of the second magnetic flux M2 flowing through the opposed surfaces can conform to the vertical direction (the reciprocating direction of the movable iron core 270) more accurately.

In the present embodiment, the permanent magnet 40 is formed into a ring shape surrounding the gap D1 (the gap provided in the initial state).

Since the magnetic flux (the second magnetic flux M2) is generated along the entire permanent magnet 40, the amount of the magnetic flux (the second magnetic flux M2) flowing through the opposed surfaces can be increased. Further, since the magnetic flux (the second magnetic flux M2) generated by the permanent magnet 40 flows through the entire circumference of the opposed surfaces, the magnetic flux between the opposed surfaces can be equalized. Accordingly, the direction of the attractive force acting on the movable iron core 270 for moving toward the fixed iron core 260 can be prevented from inclining with respect to the reciprocating direction of the movable iron core 270, so that the movable iron core 270 can reciprocate more smoothly.

In the present embodiment, the permanent magnet 40 is arranged in such a manner as to overlap with at least one of the fixed iron core 260 and the movable iron core 270 in the initial state as viewed in the direction perpendicular to the reciprocating direction of the movable iron core 270.

Since the magnetized surfaces (the upper surface 41 and the lower surface 42) of the permanent magnet 40 are brought closer to the fixed iron core 260 or the movable iron core 270, the magnetic flux (the second magnetic flux M2) generated by the permanent magnet 40 can flow through the opposed surfaces more efficiently. Accordingly, the attractive force acting on the movable iron core 270 for moving toward the fixed iron core 260 can further be improved.

The electromagnetic relay 10 according to the present embodiment is equipped with the electromagnetic device 20.

The present embodiment can provide the electromagnetic device 20 with the improved attractive force acting on the movable iron core 270 for moving toward the fixed iron core 260, and can provide the electromagnetic relay 10 equipped with the electromagnetic device 20.

Second Embodiment

An electromagnetic device 20A according to the present embodiment has substantially the same structure as the electromagnetic device 20 described in the first embodiment. The electromagnetic relay 10 is equipped with this electromagnetic device 20A. Namely, the electromagnetic relay 10 includes the electromagnetic device 20A located on the lower side and the contact device 30 located on the upper side.

The electromagnetic device 20A can also improve the attractive force acting on the movable iron core (the movable member) 270 for moving toward the fixed iron core (the fixed member) 260.

In particular, the attractive force acting on the movable iron core 270 for moving toward the fixed iron core 260 can be improved by use of the second magnetic flux M2 generated by the permanent magnet 40.

The shape and the arrangement position of the permanent magnet 40 are also the same as those in the electromagnetic device 20 described in the first embodiment.

Figure 6:
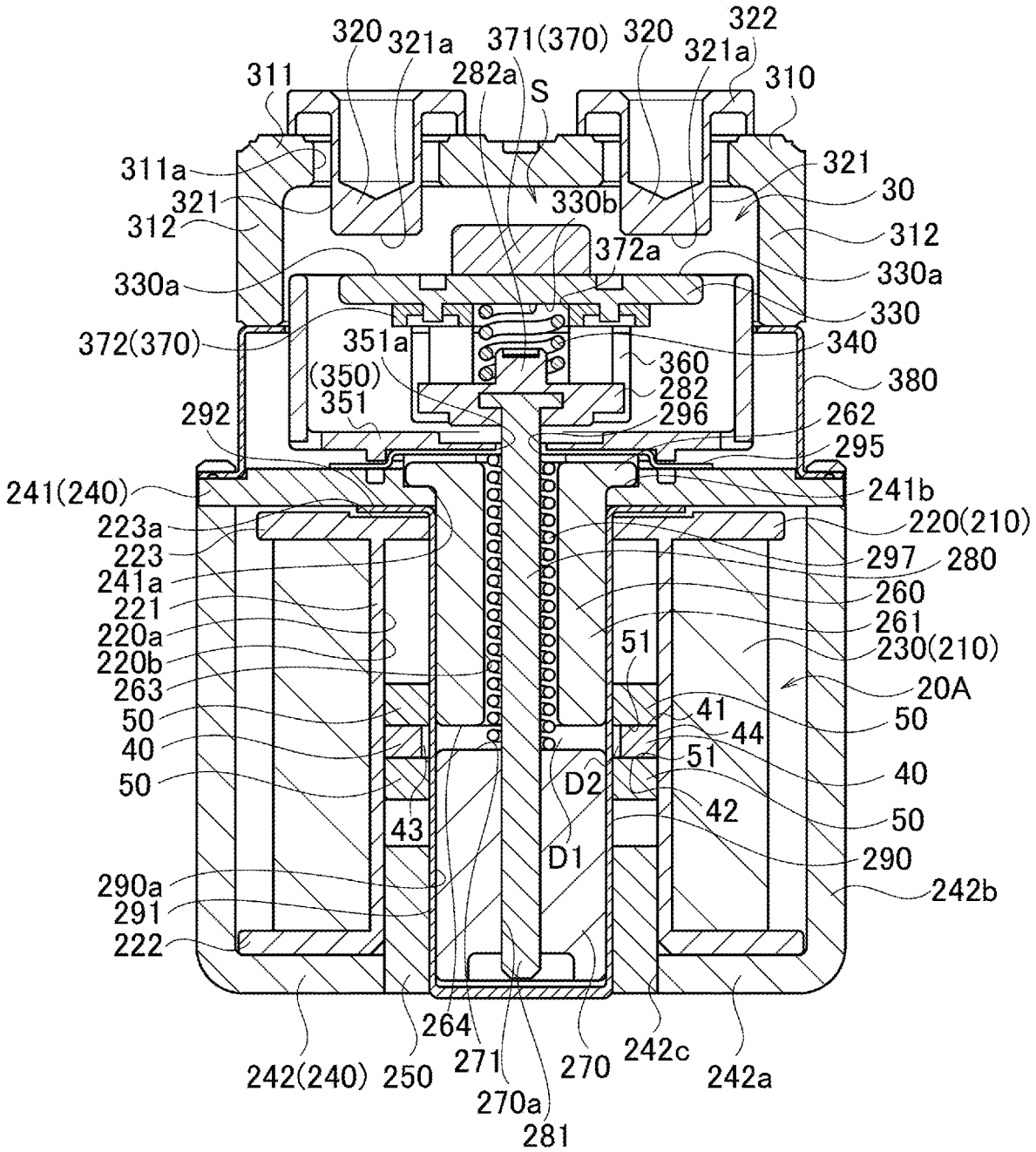
FIG. 6 is a cross-sectional view of a contact device and an electromagnetic device according to a second embodiment of the present invention.
Figure 7:
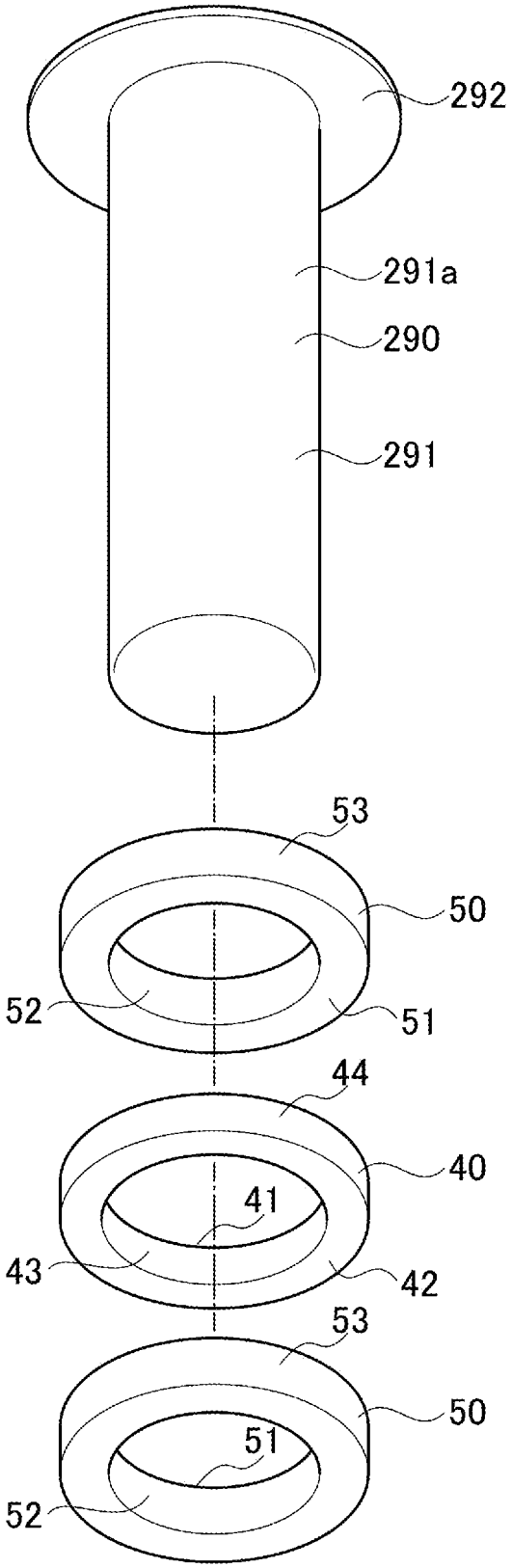
FIG. 7 is a perspective view of a plunger cap, a magnetic body, and a permanent magnet according to the second embodiment of the present invention.
Figure 8:
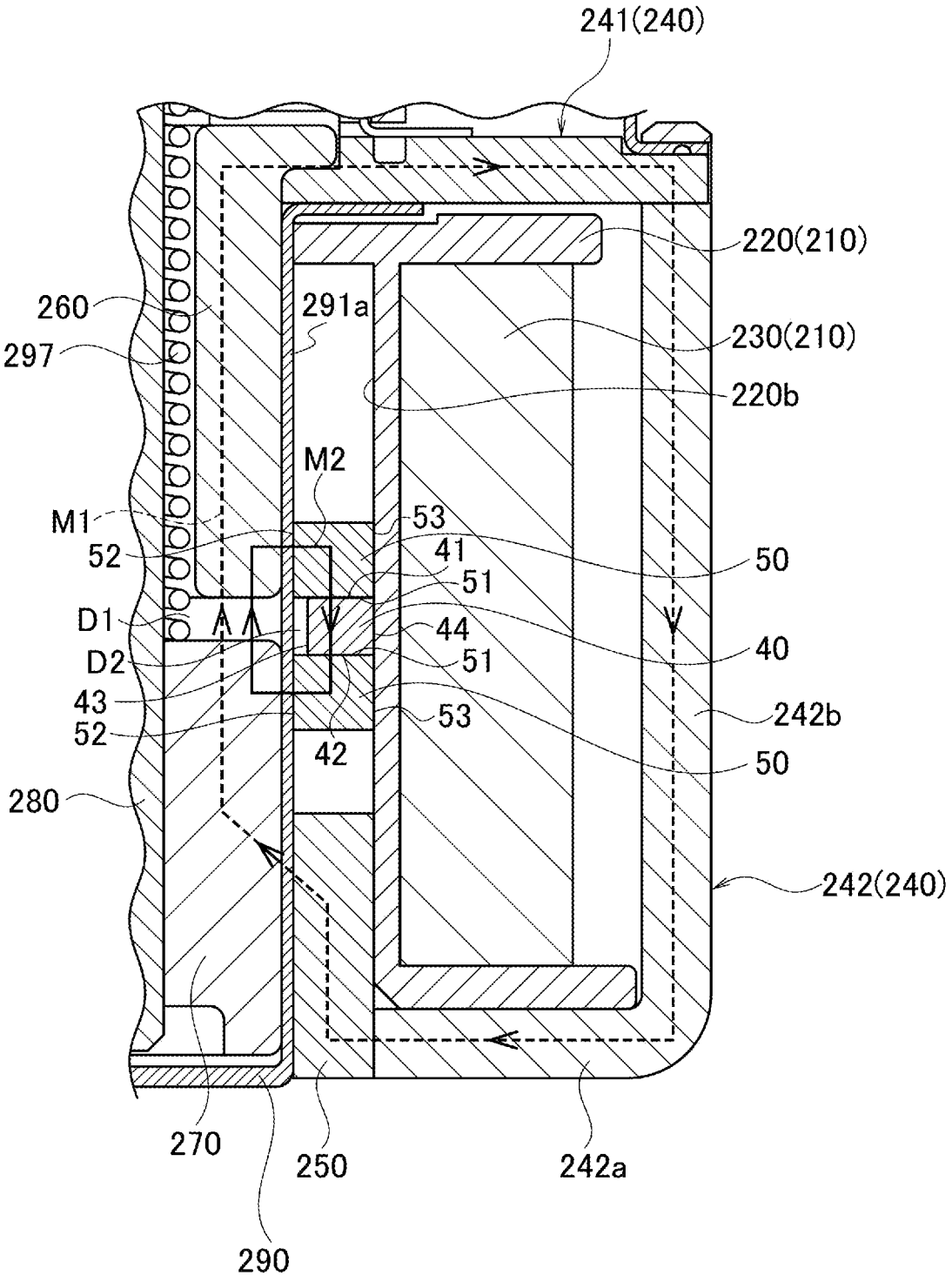
FIG. 8 is a view for schematically illustrating a flow of a magnetic flux generated in an electromagnetic relay according to the second embodiment of the present invention.

As shown in FIG. 6 and FIG. 7, the present embodiment uses a magnetic body 50 placed on at least one of the magnetized surfaces (the upper surface 41 and the lower surface 42) of the permanent magnet 40.

More particularly, the magnetic body 50 is placed on each of the upper surface 41 and the lower surface 42 of the permanent magnet 40.

In the present embodiment, as shown in FIG. 6 and FIG. 7, the circular (ring-shaped) magnetic body 50 having a substantially rectangular shape in cross section is placed on both upper and lower sides of the permanent magnet 40. The magnetic body 50 is arranged on the upper side of the permanent magnet 40 such that the lower surface 51 (the surface toward the permanent magnet 40) is in contact with the upper surface 41 of the permanent magnet 40. The magnetic body 50 is arranged on the lower side of the permanent magnet 40 such that the upper surface 51 (the surface toward the permanent magnet 40) is in contact with the lower surface 42 of the permanent magnet 40.

The magnetic body 50 located on the upper surface 41 of the permanent magnet 40 overlaps with the fixed iron core 260 (the iron core located toward the corresponding magnetic body 50), as viewed in the radial direction (in the direction perpendicular to the reciprocating direction of the movable iron core 270). The magnetic body 50 located on the lower surface 42 of the permanent magnet 40 overlaps with the movable iron core 270 at least in the initial state (the iron core located toward the corresponding magnetic body 50), as viewed in the radial direction (in the direction perpendicular to the reciprocating direction of the movable iron core 270).

The magnetic body 50 may be placed on only one of the upper surface 41 and the lower surface 42 of the permanent magnet 40.

In the present embodiment, the circular magnetic body 50 is placed in the insertion hole 220*a* of the coil bobbin 220 such that the inner surface 52 is in contact with the outer surface 291*a* of the body 291 of the plunger cap 290 and the outer surface 53 is in contact with the inner surface 220*b* of the insertion hole 220*a*, as shown in FIG. 6. The magnetic body 50 may be fixed in the insertion hole 220*a* by any conventional method such as fitting and adhesion.

The present embodiment described above can also achieve the similar advantageous effects as the first embodiment.

In the present embodiment, the magnetic body 50 is placed on at least one of the magnetized surfaces (the upper surface 41 and the lower surface 42) of the permanent magnet 40.

This arrangement of the magnetic body 50 can reduce the magnetic resistance between the permanent magnet 40 and the movable iron core 270 or between the permanent magnet 40 and the fixed iron core 260, so as to further increase the magnetic flux (the second magnetic flux M2) flowing through the opposed surfaces. Accordingly, the attractive force acting on the movable iron core 270 for moving toward the fixed iron core 260 can further be improved.

In the present embodiment, the magnetic body 50 overlaps with the iron core located toward the corresponding magnetic body 50 (the iron core at least in the initial state), as viewed in the direction perpendicular to the reciprocating direction of the movable iron core 270.

This arrangement of the magnetic body 50 can reduce the magnetic resistance between the permanent magnet 40 and the movable iron core 270 or between the permanent magnet 40 and the fixed iron core 260, so as to further increase the magnetic flux (the second magnetic flux M2) flowing through the opposed surfaces. Accordingly, the attractive force acting on the movable iron core 270 for moving toward the fixed iron core 260 can further be improved.

Figure 9:
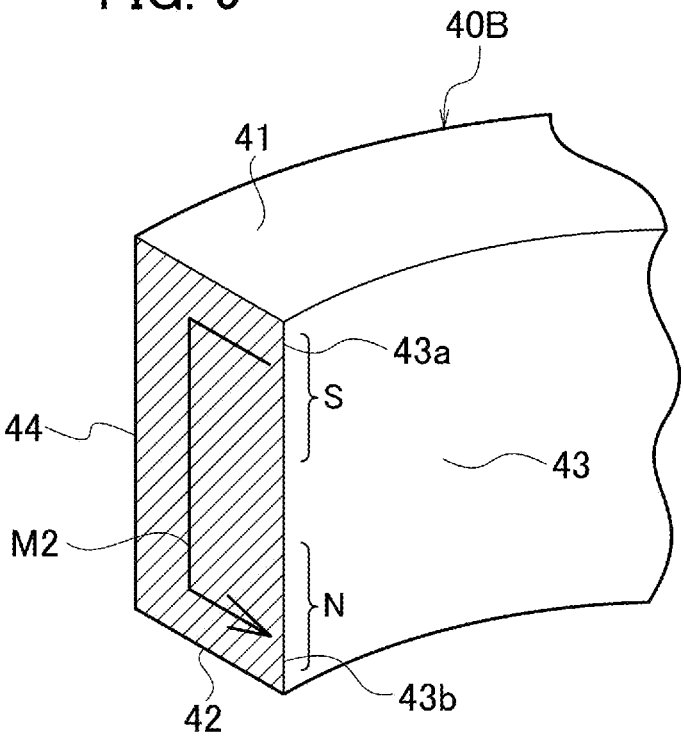
FIG. 9 is a perspective cross-sectional view partly showing a permanent magnet according to a first modified example of the first and the second embodiment of the present invention.

Although the first and second embodiments exemplified the permanent magnet 40 in which the normal direction of the pair of magnetized surfaces (the upper surface 41 and the lower surface 42) corresponds to the vertical direction (the reciprocating direction of the movable iron core 270), a permanent magnet 40B shown in FIG. 9 may be used instead.

The permanent magnet 40B shown in FIG. 9 has a circular shape (a ring-like shape) with a substantially rectangular cross section, and is provided with a pair of magnetized surfaces on the inner surface 43 of the permanent magnet 40B. In particular, the upper portion 43*a* on the inner surface 43 serves as the S-pole, and the lower portion 43*b* on the inner surface 43 serves as the N-pole.

The permanent magnet 40B shown in FIG. 9 thus includes at least one of the magnetized surfaces (the upper portion 43*a* and the lower portion 43*b* on the inner surface 43) extending in the vertical direction (in the reciprocating direction of the movable iron core 270).

Figure 10:
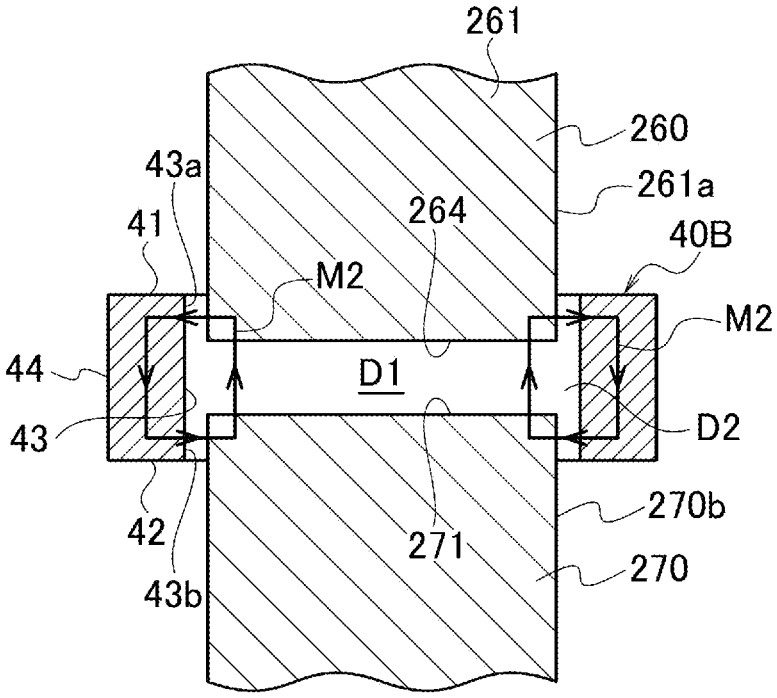
FIG. 10 is a view for schematically illustrating a flow of a magnetic flux generated in an electromagnetic relay using the permanent magnet according to the first modified example of the first and the second embodiment of the present invention.

For example, the permanent magnet 40B may be arranged in the state in which the upper portion 43*a* on the inner surface 43 serving as the S-pole is opposed to the outer circumferential surface 261*a* of the cylinder portion 261 of the fixed iron core 260, and the lower portion 43*b* on the inner surface 43 serving as the N-pole is opposed to the outer circumferential surface 270*b* of the movable iron core 270, as shown in FIG. 10.

This arrangement can also increase the magnetic flux (the second magnetic flux M2) generated by the permanent magnet 40B and flowing through the opposed surfaces more efficiently, so as to further improve the attractive force acting on the movable iron core 270 for moving toward the fixed iron core 260.

Alternatively, the permanent magnet 40B may be arranged such that at least one of the magnetized surfaces is opposed to the gap D1, as shown in FIG. 11.

Figure 11A:
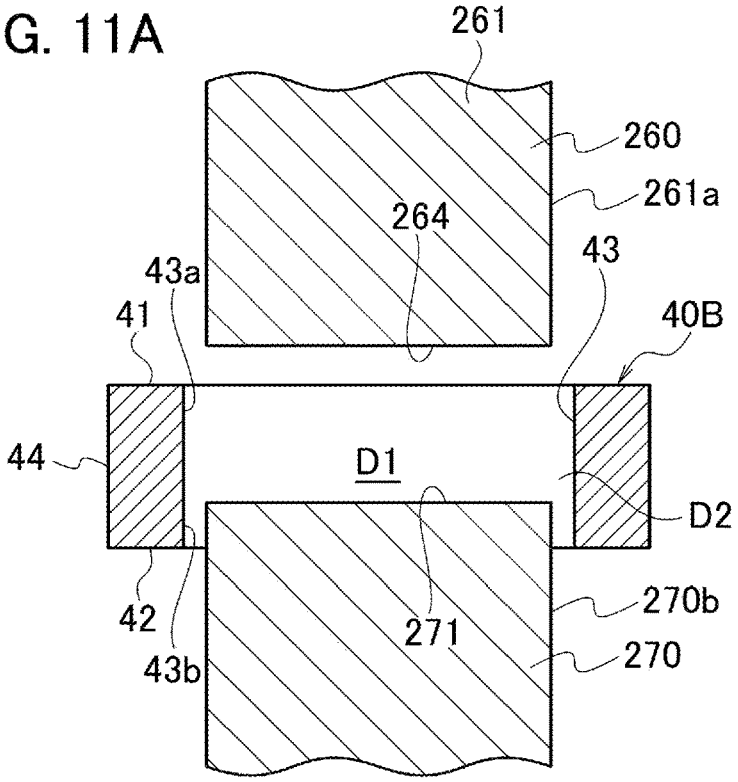
FIG. 11A is a schematic cross-sectional view showing a first arrangement example of the permanent magnet according to the first modified example of the first and the second embodiment of the present invention.

FIG. 11A illustrates the case in which the permanent magnet 40B is arranged such that the upper portion 43*a* on the inner surface 43 serving as the S-pole is opposed to the gap D1, and the lower portion 43*b* on the inner surface 43 serving as the N-pole is opposed to the outer circumferential surface 270*b* of the movable iron core 270.

The permanent magnet 40B may also be arranged in the state in which the upper portion 43*a* on the inner surface 43 serving as the S-pole is opposed to the outer circumferential surface 261*a* of the cylinder portion 261 of the fixed iron core 260, and the lower portion 43*b* on the inner surface 43 serving as the N-pole is opposed to the gap D1.

Figure 11B:
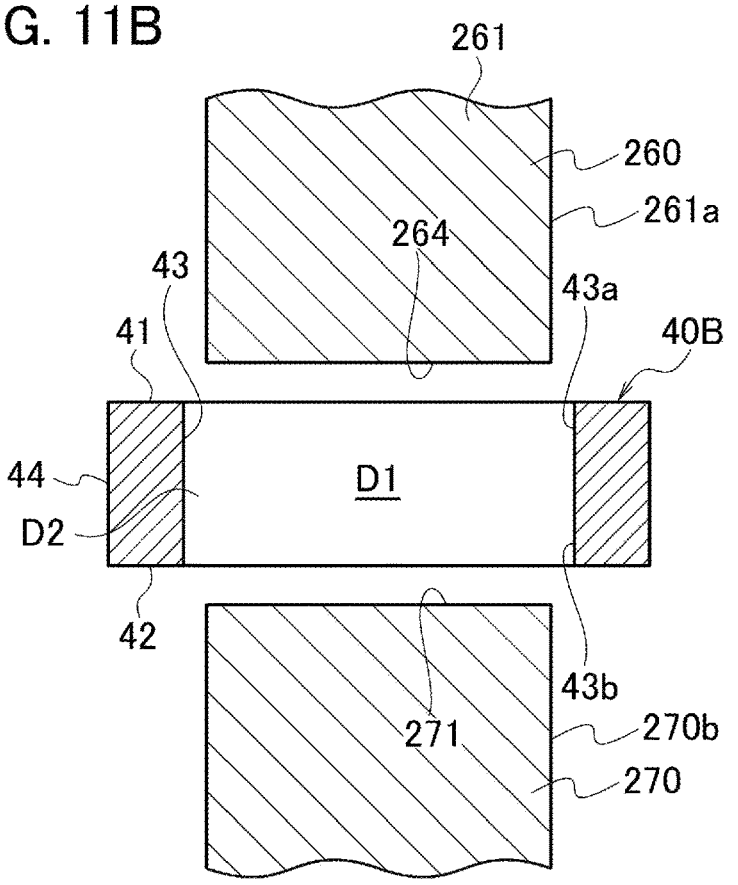
FIG. 11B is a schematic cross-sectional view showing a second arrangement example of the permanent magnet according to the first modified example of the first and the second embodiment of the present invention.

FIG. 11B illustrates the case in which the permanent magnet 40B is arranged such that the upper portion 43*a* on the inner surface 43 serving as the S-pole is opposed to the gap D1, and the lower portion 43*b* on the inner surface 43 serving as the N-pole is also opposed to the gap D1.

Figure 12:
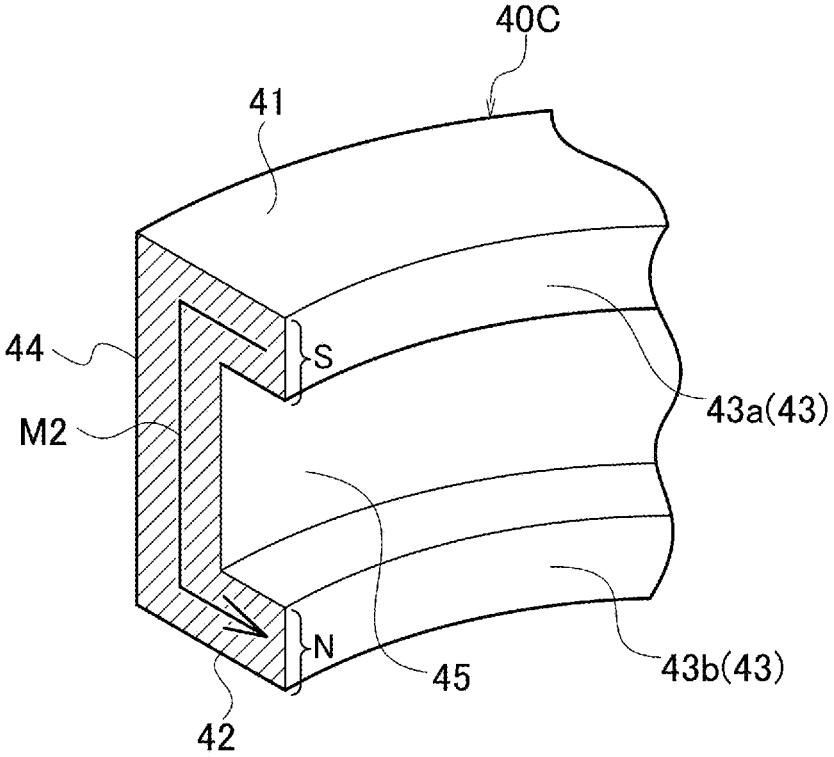
FIG. 12 is a perspective cross-sectional view partly showing a permanent magnet according to a second modified example of the first and the second embodiment of the present invention.

A permanent magnet 40C shown in FIG. 12 may also be used instead.

The permanent magnet 40C shown in FIG. 12 has a circular shape (a ring-like shape) with a substantially square C-shape in cross section, and is provided with a pair of magnetized surfaces on the inner surface 43 thereof. In particular, the upper portion 43*a* on the inner surface 43 serves as the S-pole, and the lower portion 43*b* on the inner surface 43 serves as the N-pole. A recess 45 is provided along the inner surface 43 between the upper portion 43*a* and the lower portion 43*b* with the depth direction conforming to the radial direction.

The permanent magnet 40C shown in FIG. 12 thus includes at least one of the magnetized surfaces (the upper portion 43*a* and the lower portion 43*b* on the inner surface 43) extending in the vertical direction (in the reciprocating direction of the movable iron core 270).

Figure 13:
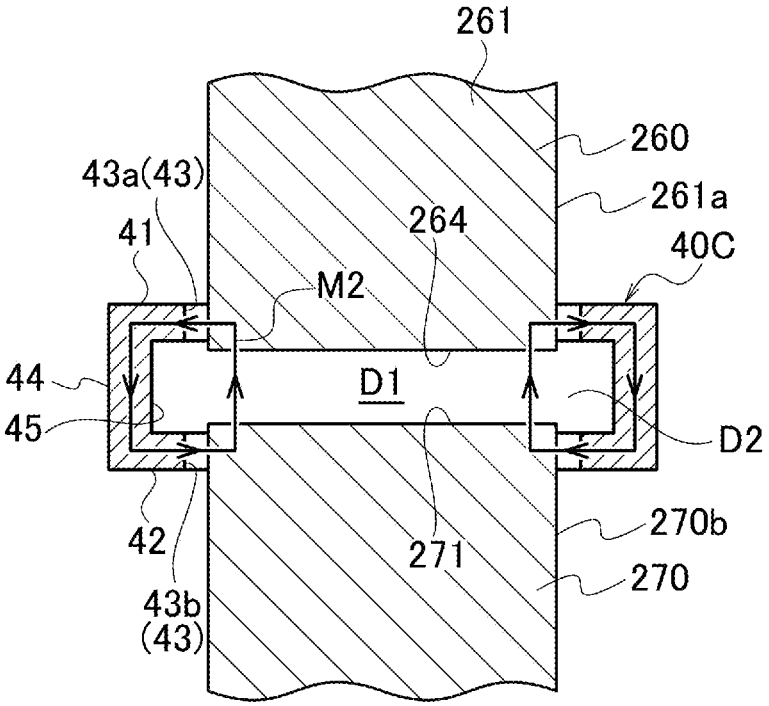
FIG. 13 is a view for schematically illustrating a flow of a magnetic flux generated in an electromagnetic relay using the permanent magnet according to the second modified example of the first and the second embodiment of the present invention.

For example, the permanent magnet 40C may be arranged in the state in which the upper portion 43*a* on the inner surface 43 serving as the S-pole is opposed to the outer circumferential surface 261*a* of the cylinder portion 261 of the fixed iron core 260, and the lower portion 43*b* on the inner surface 43 serving as the N-pole is opposed to the outer circumferential surface 270*b* of the movable iron core 270, as shown in FIG. 13.

This arrangement can also increase the magnetic flux (the second magnetic flux M2) generated by the permanent magnet 40C and flowing through the opposed surfaces more efficiently, so as to further improve the attractive force acting on the movable iron core 270 for moving toward the fixed iron core 260.

The permanent magnet 40C may be arranged such that at least one of the magnetized surfaces is opposed to the gap D1, as shown in FIG. 14.

Figure 14A:
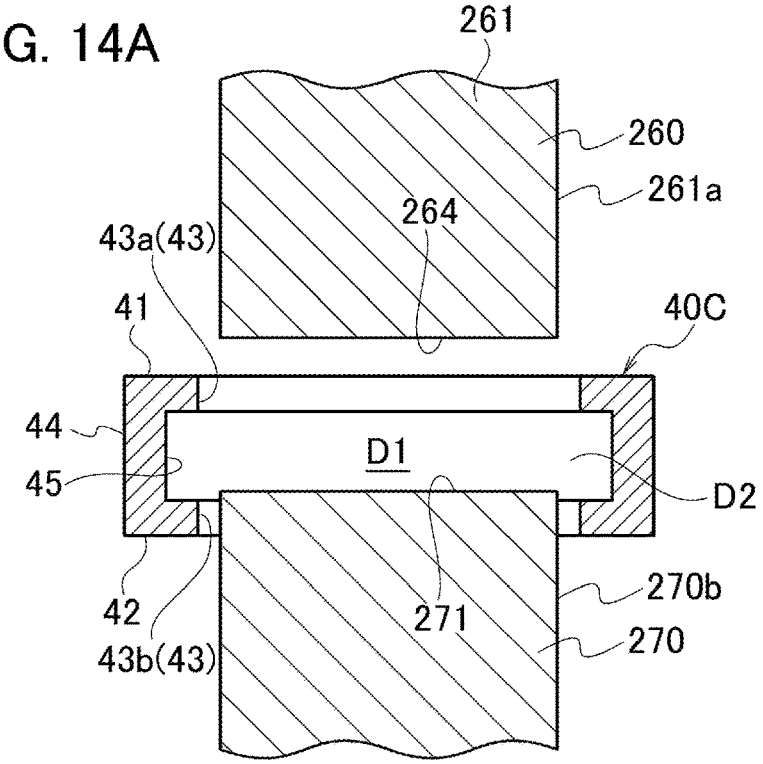
FIG. 14A is a schematic cross-sectional view showing a first arrangement example of the permanent magnet according to the second modified example of the first and the second embodiment of the present invention.

FIG. 14A illustrates the case in which the permanent magnet 40C is arranged such that the upper portion 43*a* on the inner surface 43 serving as the S-pole is opposed to the gap D1, and the lower portion 43*b* on the inner surface 43 serving as the N-pole is opposed to the outer circumferential surface 270*b* of the movable iron core 270.

The permanent magnet 40C may also be arranged in the state in which the upper portion 43*a* on the inner surface 43 serving as the S-pole is opposed to the outer circumferential surface 261*a* of the cylinder portion 261 of the fixed iron core 260, and the lower portion 43*b* on the inner surface 43 serving as the N-pole is opposed to the gap D1.

Figure 14B:
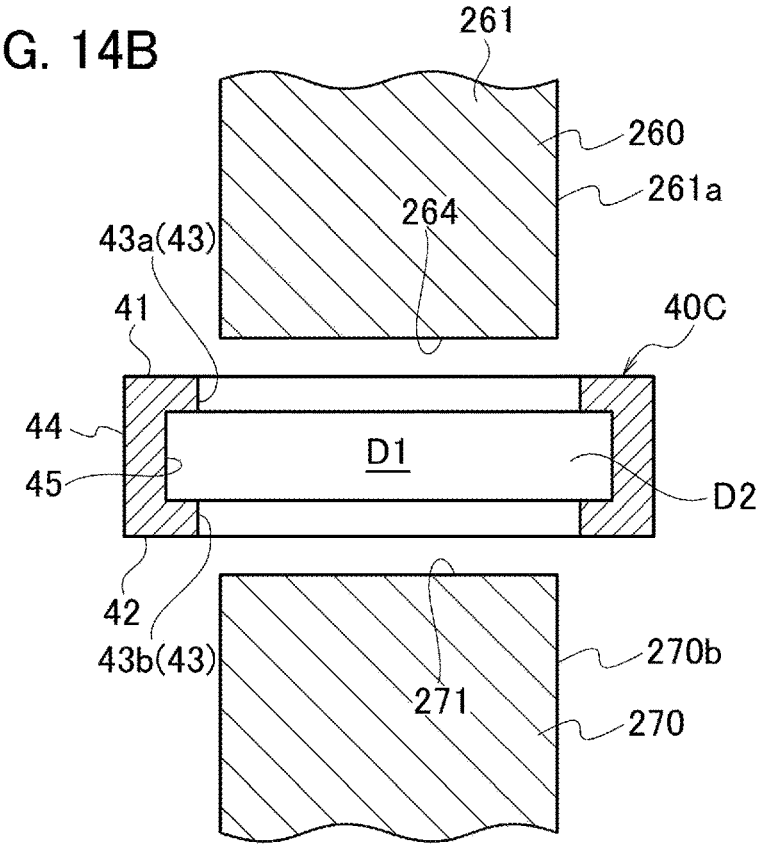
FIG. 14B is a schematic cross-sectional view showing a second arrangement example of the permanent magnet according to the second modified example of the first and the second embodiment of the present invention.

FIG. 14B illustrates the case in which the permanent magnet 40C is arranged such that the upper portion 43*a* on the inner surface 43 serving as the S-pole is opposed to the gap D1, and the lower portion 43*b* on the inner surface 43 serving as the N-pole is also opposed to the gap D1.

The use of the permanent magnet 40B or the permanent magnet 40C can decrease the distance between the magnetized surfaces (the upper portion 43*a* and the lower portion 43*b* on the inner surface 43) and the fixed iron core 260 or the movable iron core 270. Accordingly, the magnetic flux (the second magnetic flux M2) flowing through the opposed surfaces can be increased more efficiently, so as to further improve the attractive force acting on the movable iron core 270 for moving toward the fixed iron core 260.

As described above, the permanent magnet 40 includes the pair of magnetized surfaces (the upper surface 41 and the lower surface 42) of which the normal direction corresponds to the vertical direction (the reciprocating direction of the movable iron core 270). The permanent magnet 40B and the permanent magnet 40C each include the pair of magnetized surfaces (the upper portion 43*a* and the lower portion 43*b* on the inner surface 43) each extending in the vertical direction (in the reciprocating direction of the movable iron core 270).

Alternatively, a permanent magnet may be used in which the normal direction of one of magnetized surfaces corresponds to the vertical direction (the reciprocating direction of the movable iron core 270), and the other magnetized surface extends in the vertical direction (in the reciprocating direction of the movable iron core 270).

For example, a permanent magnet may be used in which the upper surface 41 serves as the S-pole and the lower portion 43*b* on the inner surface serves as the N-pole, or in which the upper portion 43*a* on the inner surface 43 serves as the S-pole and the lower surface 42 serves as the N-pole.

Any permanent magnet described above may be provided with the magnetic body on at least one of the pair of magnetized surfaces.

Third Embodiment

Figure 15:
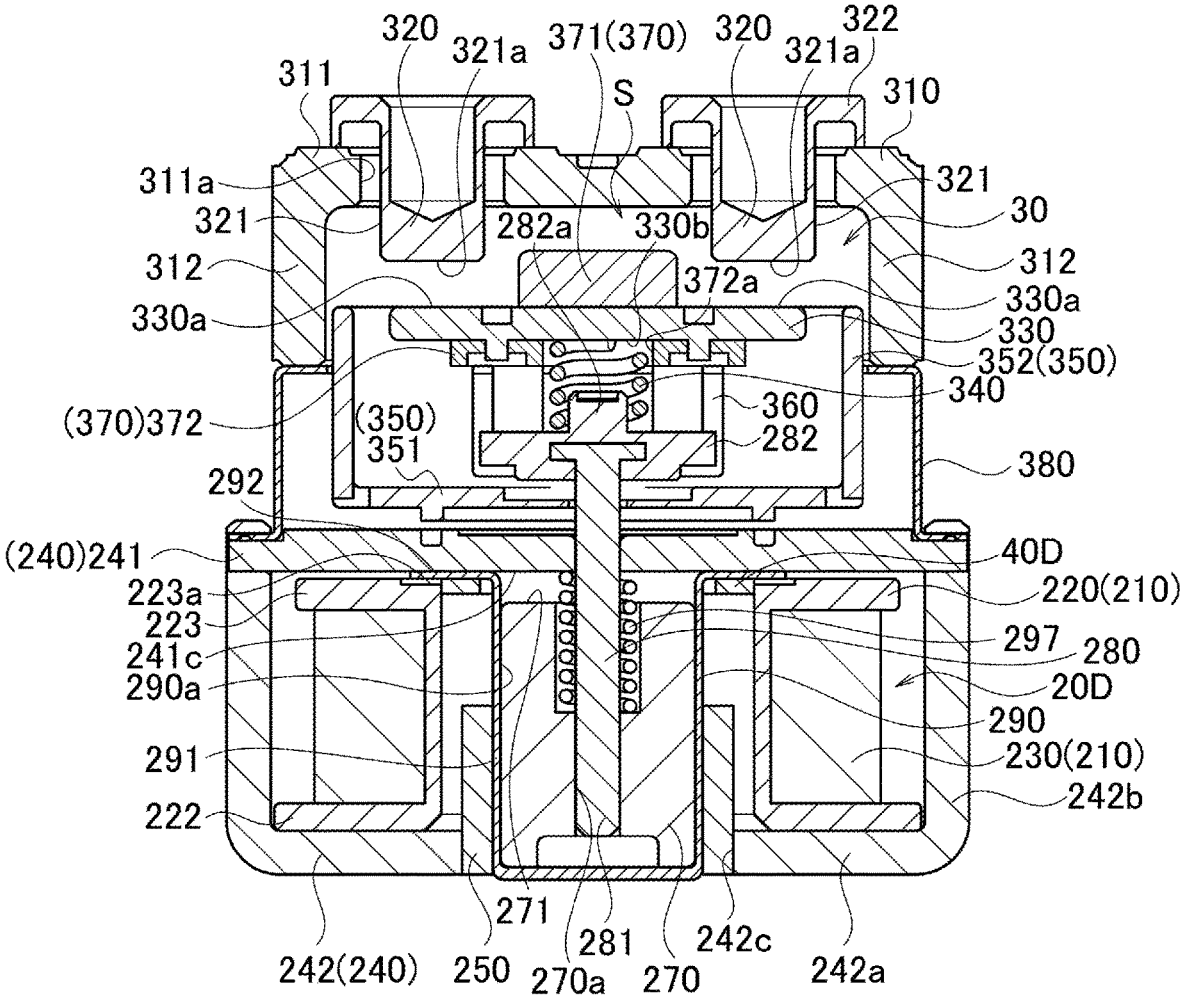
FIG. 15 is a cross-sectional view of a contact device and an electromagnetic device according to a third embodiment of the present invention.

An electromagnetic device 20D according to the present embodiment differs from the electromagnetic device 20 or the electromagnetic device 20A in excluding the fixed iron core, as shown in FIG. 15. The other configurations are substantially the same as those of the electromagnetic device 20 and the electromagnetic device 20A. The electromagnetic relay 10 is equipped with this electromagnetic device 20D. Namely, the electromagnetic relay 10 includes the electromagnetic device 20D located on the lower side and the contact device 30 located on the upper side.

The present embodiment uses the yoke upper plate 241 to serve as a fixed member instead of the fixed iron core. In other words, the electromagnetic device 20D according to the present embodiment includes the yoke upper plate (the fixed member) 241 which is magnetized by the coil 230 applied with the current (allows the first magnetic flux M1 to flow therethrough), and the movable iron core (the movable member) 270 which is opposed to the yoke upper plate 241 in the vertical direction (in the shaft direction) and placed in the cylindrical inner portion (in the insertion hole 220*a*) of the coil bobbin 220.

The yoke upper plate (the fixed member) 241 is provided in the middle with the insertion hole 241*a* into which the shaft 280 is inserted. The return spring 297 is placed between the movable iron core 270 and the yoke upper plate (the fixed member) 241 to bias the movable iron core 270 by the elastic force in the direction in which the movable iron core 270 returns to the initial position (in the direction away from the yoke upper plate (the fixed member) 241).

The electromagnetic device 20D can also improve the attractive force acting on the movable iron core (the movable member) 270 for moving toward the yoke upper plate (the fixed member) 241.

In particular, the attractive force acting on the movable iron core (the movable member) 270 for moving toward the yoke upper plate (the fixed member) 241 can be improved by use of the second magnetic flux M2 generated by a permanent magnet 40D.

Figure 16:
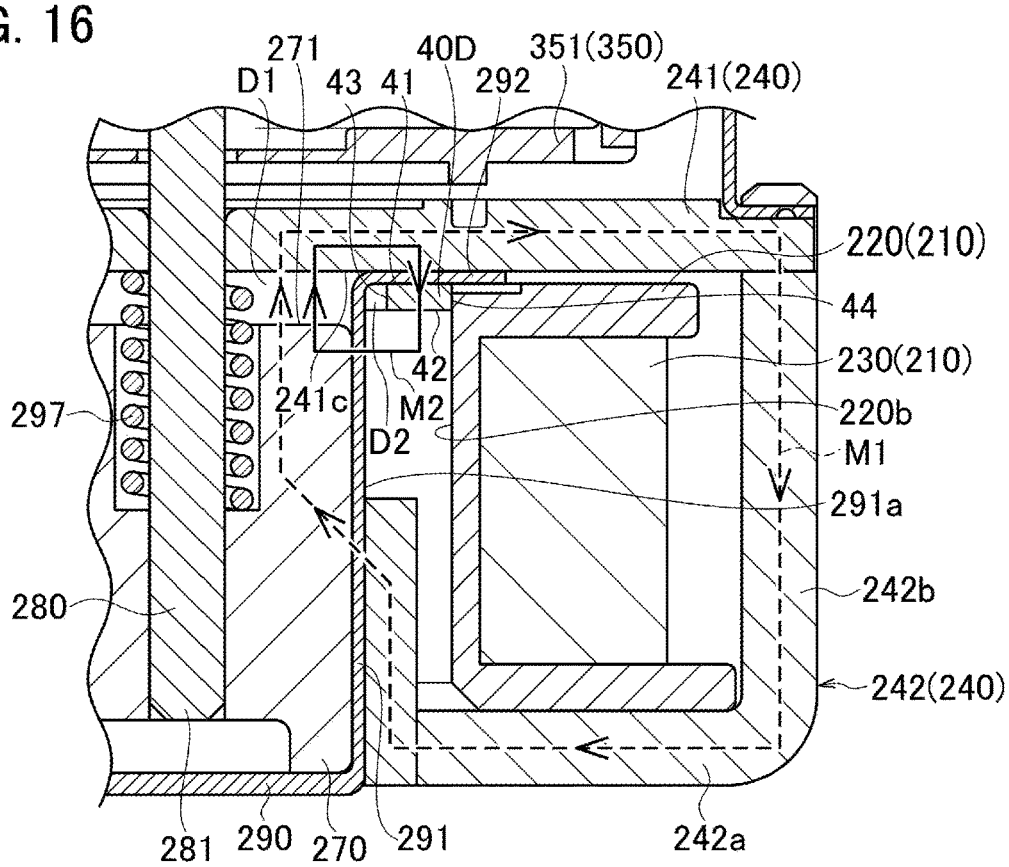
FIG. 16 is a view for schematically illustrating a flow of a magnetic flux generated in an electromagnetic relay according to the third embodiment of the present invention.

The present embodiment uses the circular (ring-shaped) permanent magnet 40D having a substantially rectangular shape in cross section, as shown in FIG. 15 and FIG. 16. The permanent magnet 40D has the upper surface 41 and the lower surface 42 serving as magnetized surfaces opposed to each other in the penetration direction conforming to the vertical direction. FIG. 16 illustrates the permanent magnet 40D arranged in the state in which the upper surface 41 serves as the S-pole and the lower surface 42 serves as the N-pole.

The circular permanent magnet 40D is placed in the insertion hole 220*a* of the coil bobbin 220 such that the inner surface 43 is opposed to the outer surface 291*a* of the body 291 of the plunger cap 290 with a gap interposed therebetween, as shown in FIG. 16. In the present embodiment, the upper surface 41 of the permanent magnet 40D is in contact with the lower surface of the flange 292 of the plunger cap 290, and the outer surface 44 of the permanent magnet 40D is in contact with the inner surface 220*b* of the insertion hole 220*a*. The permanent magnet 40D may be fixed in the insertion hole 220*a* by any conventional method such as fitting and adhesion.

In the present embodiment, the permanent magnet 40D is located adjacent to the gap D1 between the opposed surface 241*c* of the yoke upper plate (the fixed member) 241 opposed to the movable iron core 270 and the opposed surface 271 of the movable iron core 270 opposed to the yoke upper plate (the fixed member) 241 when the current is not applied to the coil 230.

More particularly, the permanent magnet 40D is arranged such that the inner surface 43 surrounds the entire circumference of the gap D1. In other words, as viewed in the vertical direction (in the reciprocating direction: the drive-shaft direction), the inner surface 43 of the permanent magnet 40D has a circular shape surrounding the circle defined by the outer surface of the member (the movable iron core 270) substantially corresponding to the boundary of the gap D1.

In the present embodiment, the permanent magnet 40D is arranged such that the upper portion and the lower portion of the inner surface 43 are both opposed to the gap D1. Namely, the inner surface 43 of the permanent magnet 40D entirely faces the gap D1 in the radial direction.

The permanent magnet 40D is separated from the yoke upper plate (the fixed member) 241 and the movable iron core 270 with the space D2 interposed therebetween. The size of the space D2 (the distance in the radial direction) is the sum of the gap (the distance in the radial direction) between the inner surface 43 of the permanent magnet 40D and the outer surface 291*a* and the thickness of the body 291.

This arrangement of the permanent magnet 40D leads the direction in which the paired magnetized surfaces (the upper surface 41 and the lower surface 42) of the permanent magnet 40D are opposed into conforming to the vertical direction (the reciprocating direction of the movable iron core 270).

Namely, the normal direction of the pair of magnetized surfaces (the upper surface 41 and the lower surface 42) of the permanent magnet 40D corresponds to the vertical direction (the reciprocating direction of the movable iron core 270).

In the present embodiment, the direction of the second magnetic flux M2 between the opposed surfaces (the opposed surface 241*c* and the opposed surface 271) of the yoke upper plate (the fixed member) 241 and the movable iron core 270 conforms to the direction of the first magnetic flux M1 between the opposed surfaces (the opposed surface 241*c* and the opposed surface 271) of the yoke upper plate (the fixed member) 241 and the movable iron core 270 (in FIG. 16, the upward direction).

As described above, the permanent magnet 40D of the present embodiment is arranged around the opposed surfaces (the opposed surface 241*c* and the opposed surface 271) of the yoke upper plate (the fixed member) 241 and the movable iron core 270 such that the direction of the second magnetic flux M2 conforms to the direction of the first magnetic flux M1 between the opposed surfaces.

The present embodiment described above can also achieve the similar advantageous effects as the first embodiment.

Figure 17:
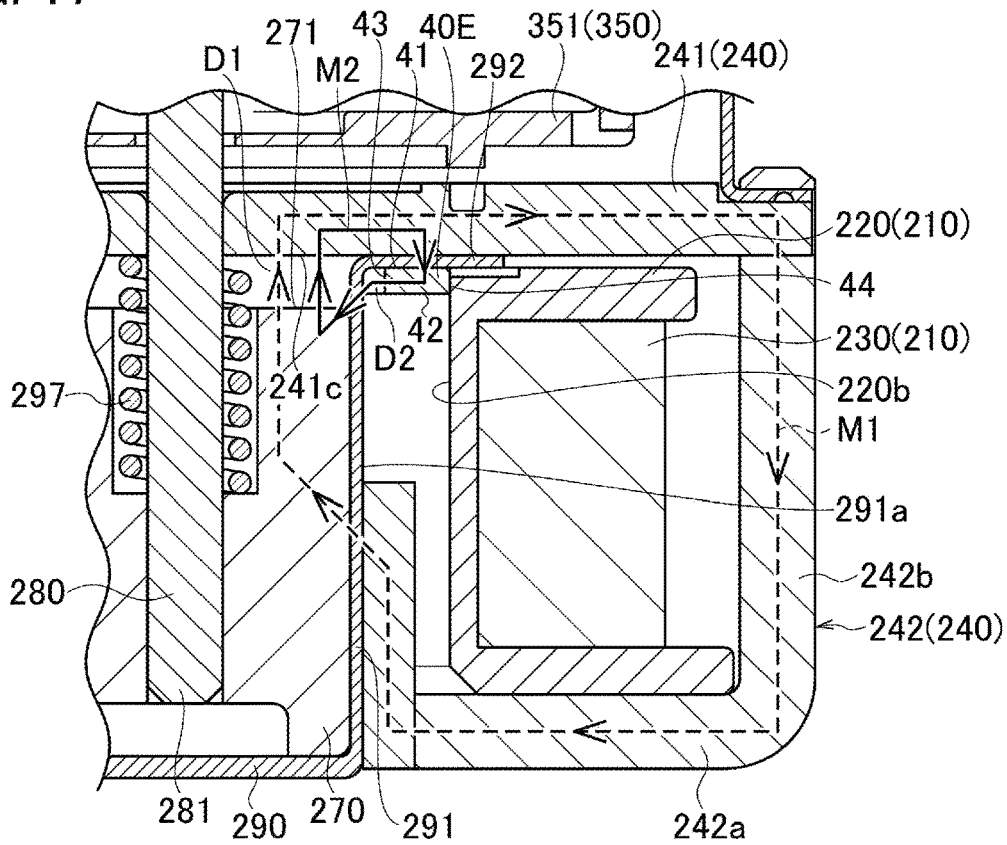
FIG. 17 is a view for schematically illustrating a flow of a magnetic flux generated in an electromagnetic relay according to a first modified example of the third embodiment of the present invention.

Although the third embodiment exemplified the permanent magnet 40D in which the normal direction of the pair of magnetized surfaces (the upper surface 41 and the lower surface 42) corresponds to the vertical direction (the reciprocating direction of the movable iron core 270), a permanent magnet 40E shown in FIG. 17 may be used instead.

The permanent magnet 40E shown in FIG. 17 has a circular shape (a ring-like shape) with a substantially rectangular cross section, in which the upper surface 41 and the inner surface 43 of the permanent magnet 40E serve as a pair of magnetized surfaces. In particular, the upper surface 41 serves as the S-pole, and the inner surface 43 serves as the N-pole.

The permanent magnet 40E shown in FIG. 17 thus includes at least one of the magnetized surfaces (the inner surface 43) extending in the vertical direction (in the reciprocating direction of the movable iron core 270).

This arrangement can also increase the magnetic flux (the second magnetic flux M2) generated by the permanent magnet 40E and flowing through the opposed surfaces more efficiently, so as to further improve the attractive force acting on the movable iron core 270 for moving toward the yoke upper plate (the fixed member) 241.

Figure 18:
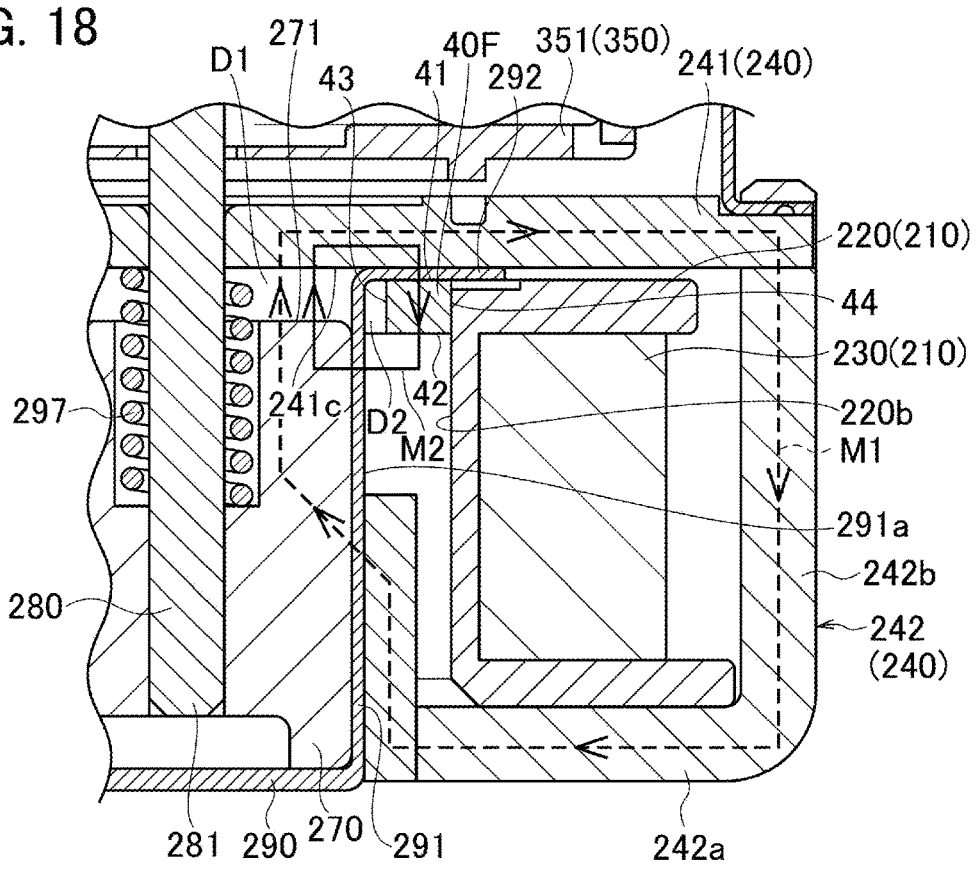
FIG. 18 is a view for schematically illustrating a flow of a magnetic flux generated in an electromagnetic relay according to a second modified example of the third embodiment of the present invention.

A permanent magnet 40F shown in FIG. 18 may also be used instead.

The permanent magnet 40F shown in FIG. 18 has a greater thickness in the vertical direction (in the reciprocating direction of the movable iron core 270) than the permanent magnet 40D and the permanent magnet 40E, and is arranged such that the lower surface 42 of the permanent magnet 40F is located below the opposed surface 271 of the movable iron core 270. The permanent magnet 40F thus overlaps with the movable iron core 270 as viewed in the radial direction (in the direction perpendicular to the reciprocating direction of the movable iron core 270).

This arrangement can also increase the magnetic flux (the second magnetic flux M2) generated by the permanent magnet 40F and flowing through the opposed surfaces more efficiently, so as to further improve the attractive force acting on the movable iron core 270 for moving toward the yoke upper plate (the fixed member) 241.

Figure 19:
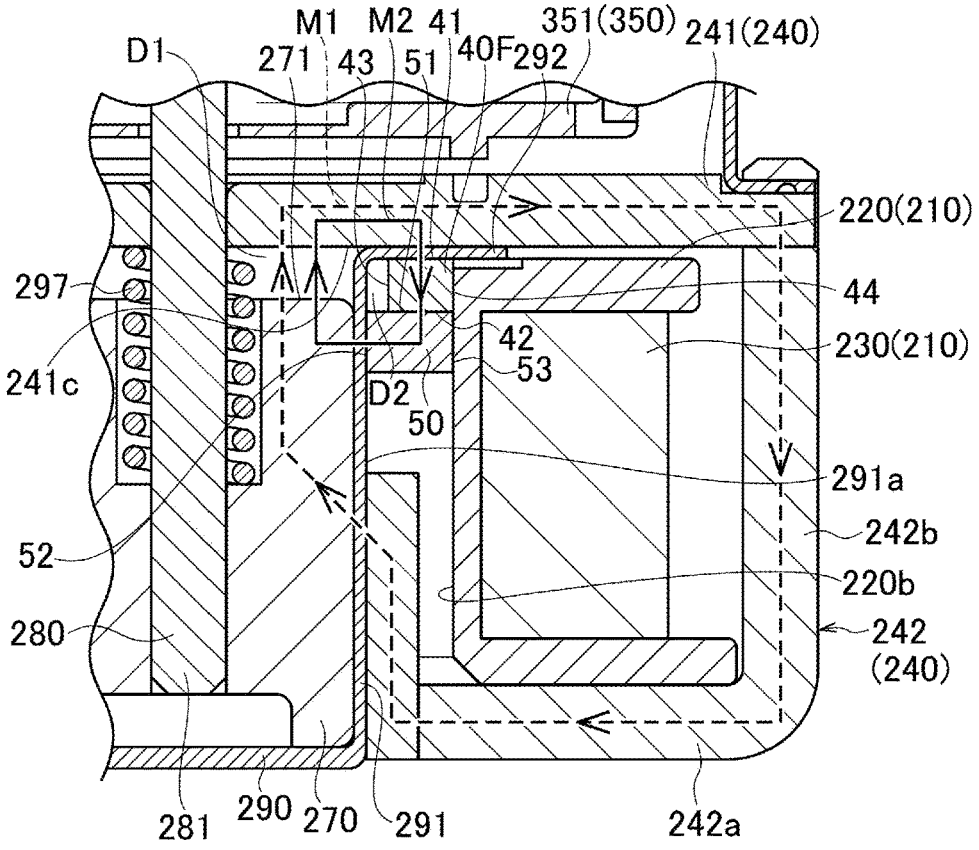
FIG. 19 is a view for schematically illustrating a flow of a magnetic flux generated in an electromagnetic relay according to a third modified example of the third embodiment of the present invention.

As shown in FIG. 19, the magnetic body 50 may further be placed on at least one of the pair of magnetized surfaces (the upper surface 41 and the lower surface 42) of the permanent magnet 40F.

In FIG. 19, the magnetic body 50 is placed on the lower surface 42 of the permanent magnet 40F.

The magnetic body 50 has a circular shape (a ring-like shape) with a substantially rectangular cross section, and is arranged such that the upper surface 51 (the surface toward the permanent magnet 40F) is in contact with the lower surface 42 of the permanent magnet 40F. In the present embodiment, the circular magnetic body 50 is placed in the insertion hole 220*a* of the coil bobbin 220 such that the inner surface 52 is in contact with the outer surface 291*a* of the body 291 of the plunger cap 290 and the outer surface 53 is in contact with the inner surface 220*b* of the insertion hole 220*a*, as shown in FIG. 19. The magnetic body 50 may be fixed in the insertion hole 220*a* by any conventional method such as fitting and adhesion.

The magnetic body 50 located on the lower surface 42 side of the permanent magnet 40F overlaps with the movable iron core 270 (the iron core located toward the corresponding magnetic body 50) at least in the initial state as viewed in the radial direction (in the direction perpendicular to the reciprocating direction of the movable iron core 270).

The magnetic body 50 may be placed on both the upper surface 41 and the lower surface 42 of the permanent magnet 40F, or may be placed only on the upper surface 41 of the permanent magnet 40F. The magnetic body 50 may also be placed on one of the pair of magnetized surfaces of the permanent magnet 40D or the permanent magnet 40E.

This arrangement can further improve the attractive force acting on the movable iron core (the movable member) 270 for moving toward the yoke upper plate (the fixed member) 241.

Figure 20A:
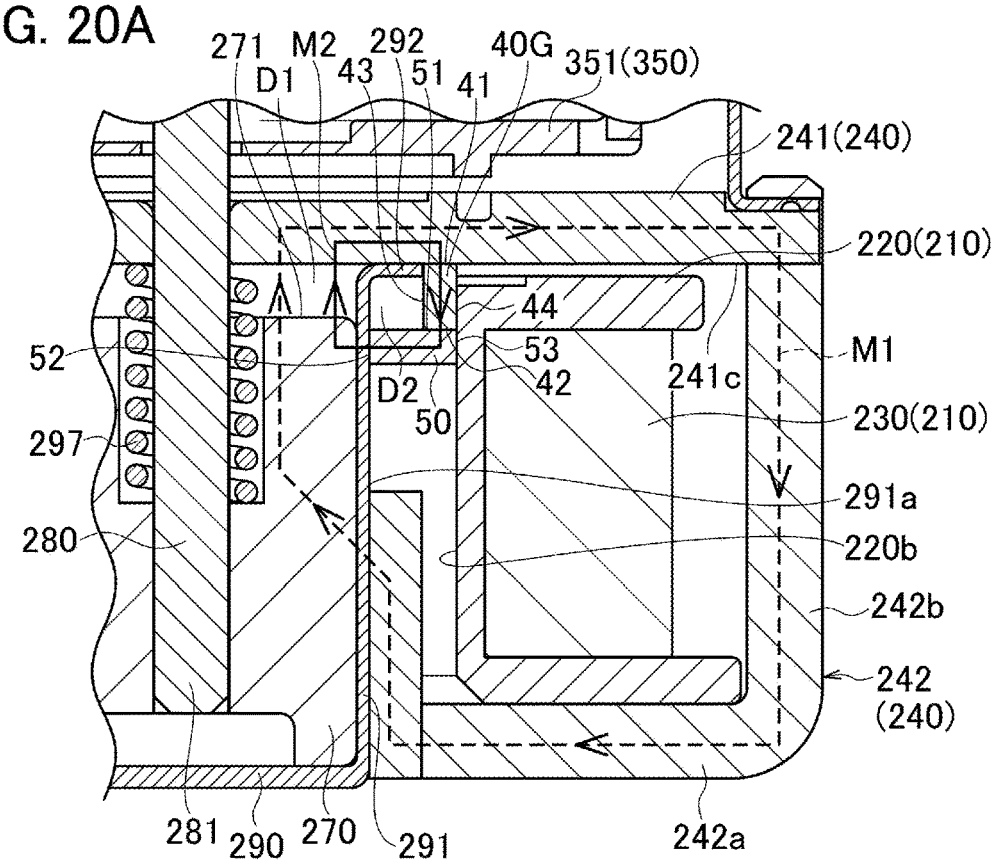
FIG. 20A is a view for schematically illustrating a flow of a magnetic flux generated in an electromagnetic relay according to a fourth modified example of the third embodiment of the present invention.
Figure 20B:
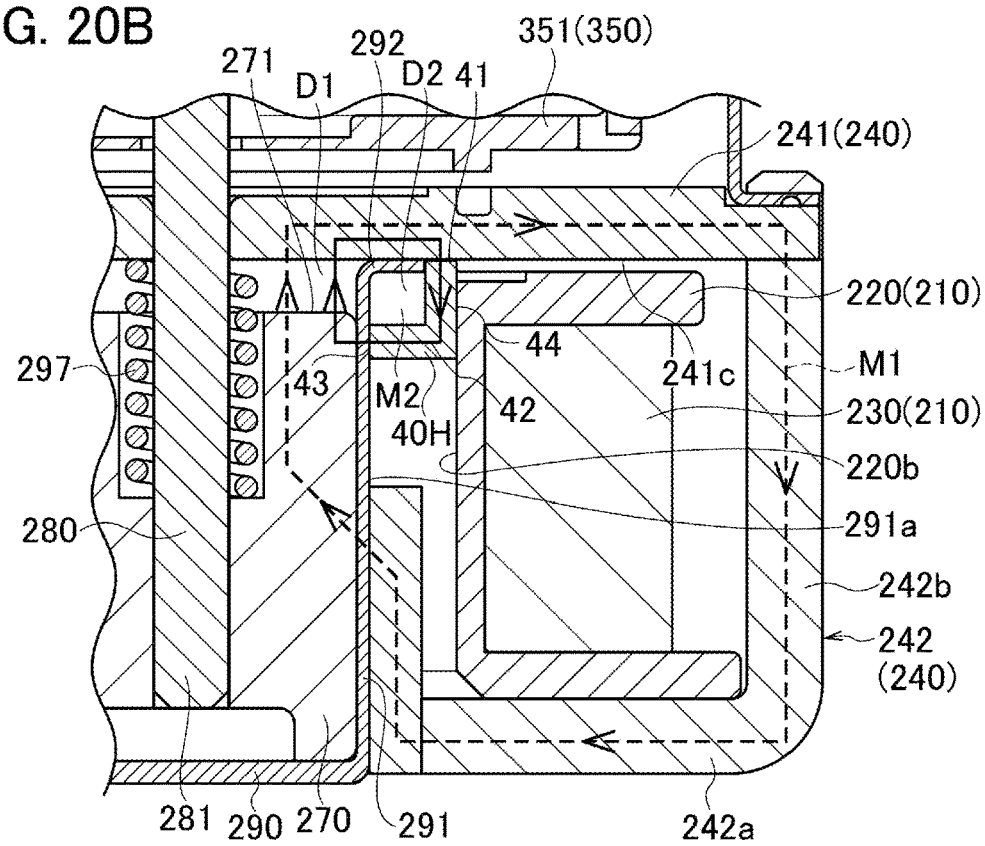
FIG. 20B is a view for schematically illustrating a flow of a magnetic flux generated in an electromagnetic relay according to a fifth modified example of the third embodiment of the present invention.

Alternatively, as shown in FIG. 20A, a permanent magnet 40G may be used and stacked on the magnetic body 50 to have a substantially L-shape in cross section, and arranged such that the upper surface 41 of the permanent magnet 40G is in contact with the lower surface 241*c* of the yoke upper plate (the fixed member) 241. As shown in FIG. 20B, a permanent magnet 40H having a substantially L-shape in cross section may also be used and arranged such that the upper surface 41 of the permanent magnet 40H is in contact with the lower surface 241*c* of the yoke upper plate (the fixed member) 241.

This arrangement can reduce the magnetic resistance between the permanent magnet 40G or the permanent magnet 40H and the yoke upper plate (the fixed member) 241, so as to further improve the attractive force acting on the movable iron core (the movable member) 270 for moving toward the yoke upper plate (the fixed member) 241.

The upper surface 41 of the permanent magnet 40G or the permanent magnet 40H may be buried into the yoke upper plate (the fixed member) 241.

The present embodiment may use the shape and the arrangement position of the respective permanent magnets shown in FIG. 9 to FIG. 14.

Fourth Embodiment

An electromagnetic device 20I according to the present embodiment has substantially the same structure as the electromagnetic device 20 described in the first embodiment. An electromagnetic relay 10I is equipped with the electromagnetic device 20I. The electromagnetic relay 10I includes the electromagnetic device 20I located on the lower side and a contact device 30I located on the upper side.

Figure 21:
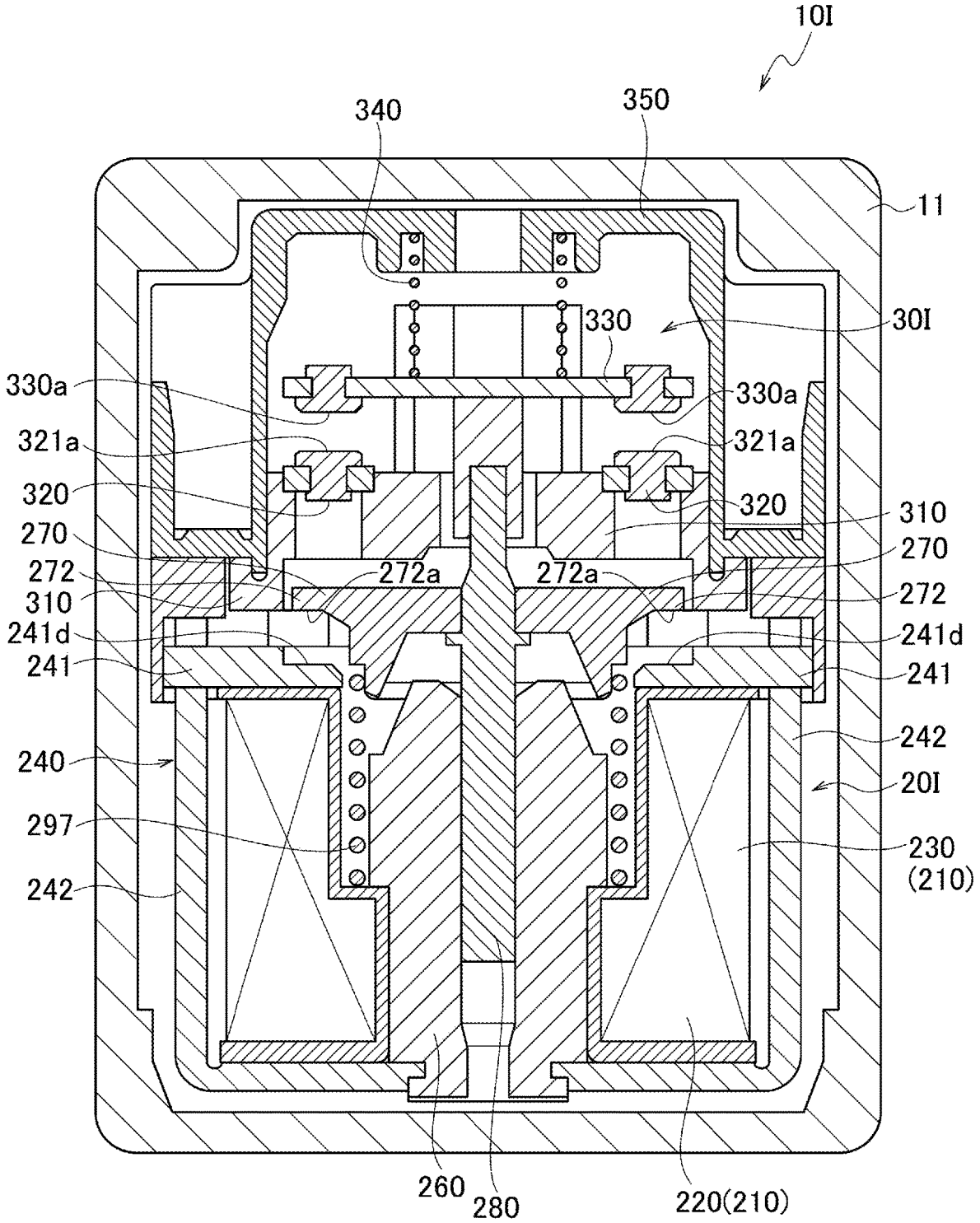
FIG. 21 is a cross-sectional view illustrating a fundamental configuration of an electromagnetic relay according to a fourth embodiment of the present invention.

As shown in FIG. 21, the electromagnetic device 20I according to the present embodiment differs from the electromagnetic device 20 in that the fixed iron core 260 is located on the lower side and the movable iron core 270 is located on the upper side. The contact device 30I according to the present embodiment includes the movable contact 330 having the movable contact points 330*a* located above the fixed terminals 320 having the fixed contact points 321*a*. The movable contact points 330*a* are brought into contact with the fixed contact points 321*a* when the movable contact 330 fixed to the movable iron core 270 via the shaft 280 moves downward (toward the electromagnetic device).

In the electromagnetic device 20I according to the present embodiment, the movable iron core 270 includes a flange 272 which is opposed to the yoke upper plate (the fixed member) 241 in the vertical direction (in the shaft direction) magnetized by the coil 230 applied with the current (allowing the first magnetic flux M1 to flow therethrough). The lower surface 272*a* of the flange 272 and the upper surface 241*d* of the yoke upper plate (the fixed member) 241 opposed to each other serve as opposed surfaces.

The opposed surfaces of the movable iron core 270 and the fixed iron core 260 further extend in the direction intersecting the horizontal plane. The extending surfaces reduce the air gap between the opposed surfaces between the movable iron core 270 and the fixed iron core 260, so as to increase the electromagnetic attractive force immediately after starting the application of the current to the coil 230.

The electromagnetic device 20I can also improve the attractive force acting on the movable iron core (the movable member) 270 for moving toward the yoke upper plate (the fixed member) 241.

Figure 22:
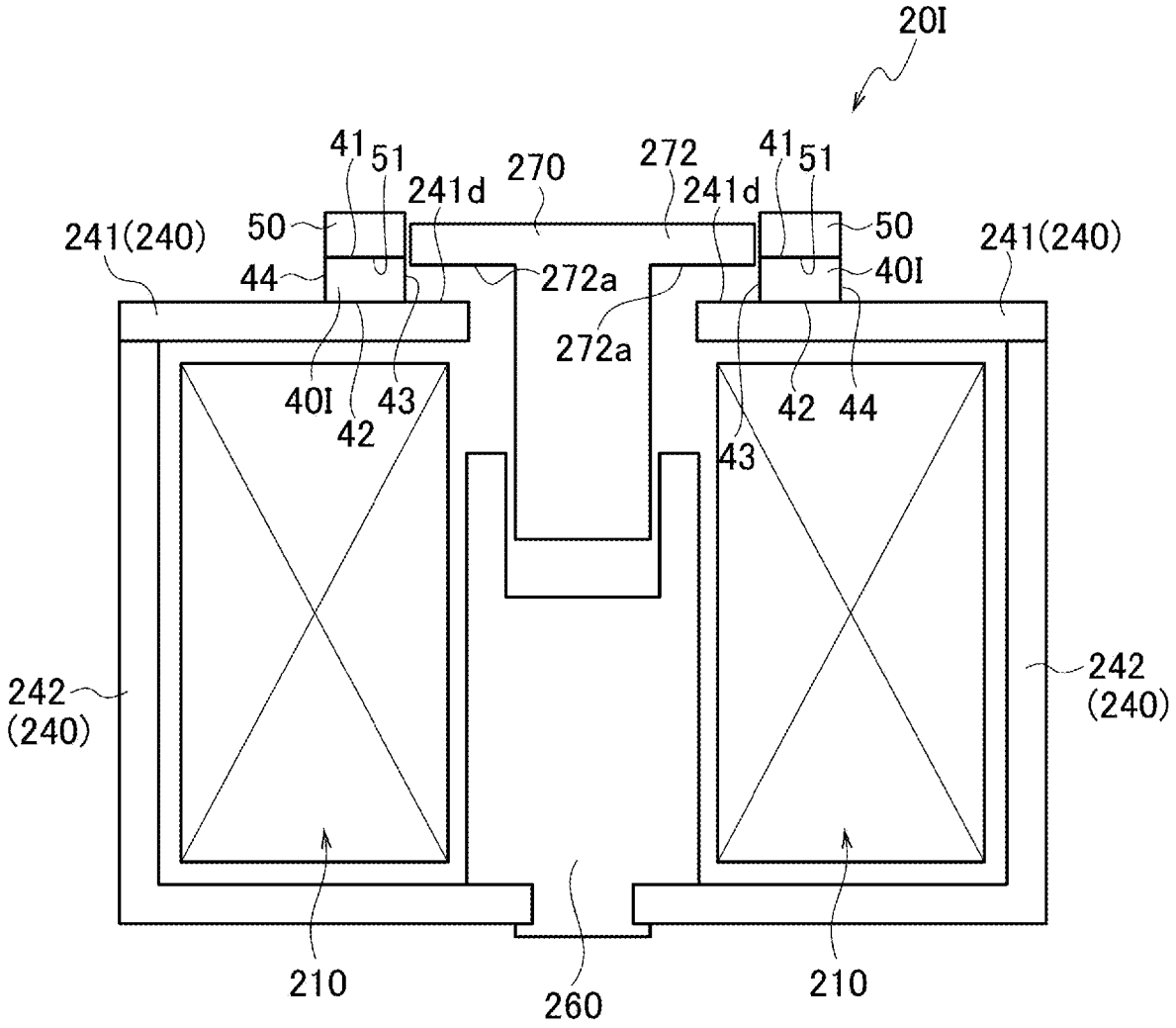
FIG. 22 is a schematic view of an electromagnetic device according to the fourth embodiment of the present invention.
Figure 23:
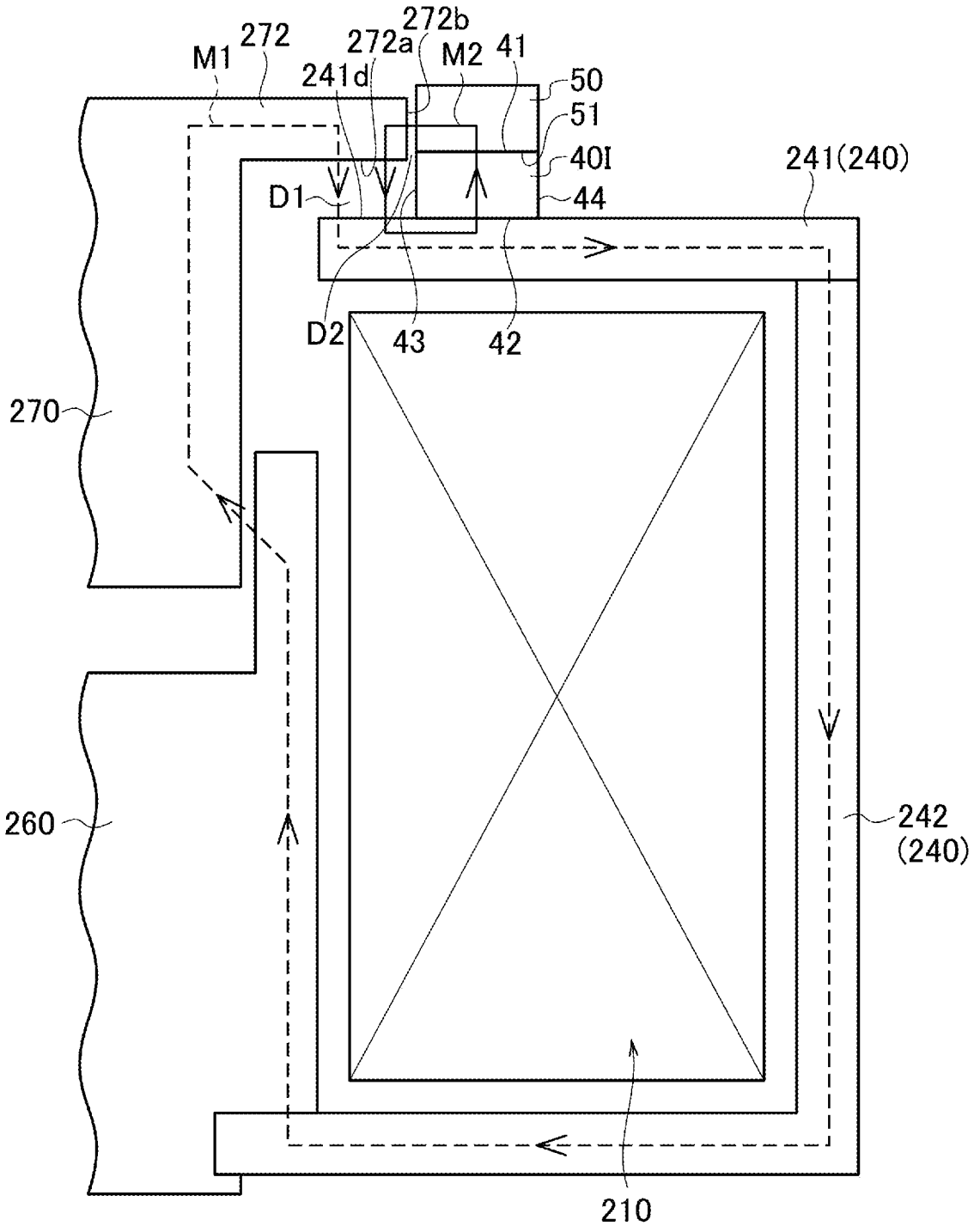
FIG. 23 is a view for schematically illustrating a flow of a magnetic flux generated in the electromagnetic relay according to the fourth embodiment of the present invention.

More particularly, as shown in FIG. 22 and FIG. 23, a permanent magnet 40I is used to generate the second magnetic flux M2, so as to improve the attractive force acting on the movable iron core (the movable member) 270 for moving toward the yoke upper plate (the fixed member) 241.

FIG. 22 simplifies the electromagnetic device 20I shown in FIG. 21. The electromagnetic device 20I according to the present embodiment is further described below with reference to FIG. 22.

The present embodiment uses the circular (ring-shaped) permanent magnet 40I having a substantially rectangular shape in cross section, as shown in FIG. 22 and FIG. 23. The permanent magnet 40I has the upper surface 41 and the lower surface 42 serving as magnetized surfaces opposed to each other in the penetration direction conforming to the vertical direction. FIG. 22 and FIG. 23 illustrate the permanent magnet 40I arranged in contact with the upper surface 241*d* of the yoke upper plate 241 in the state in which the upper surface 41 serves as the N-pole and the lower surface 42 serves as the S-pole.

In the present embodiment, the permanent magnet 40I is located adjacent to the gap D1 between the opposed surface 241*d* of the yoke upper plate (the fixed member) 241 opposed to the movable iron core 270 and the opposed surface 272*a* of the movable iron core 270 opposed to the yoke upper plate (the fixed member) 241 when the current is not applied to the coil 230.

In the present embodiment, the permanent magnet 40I is arranged such that the upper portion of the inner surface 43 overlaps with the movable iron core 270 and the lower portion of the inner surface 43 is opposed to the gap D1.

The permanent magnet 40I is separated from the yoke upper plate (the fixed member) 241 with the space D2 interposed therebetween.

This arrangement of the permanent magnet 40I leads the direction in which the paired magnetized surfaces (the upper surface 41 and the lower surface 42) of the permanent magnet 40I are opposed into conforming to the vertical direction (the reciprocating direction of the movable iron core 270).

Namely, the normal direction of the pair of magnetized surfaces (the upper surface 41 and the lower surface 42) of the permanent magnet 40I corresponds to the vertical direction (the reciprocating direction of the movable iron core 270).

In the present embodiment, the direction of the second magnetic flux M2 between the opposed surfaces (the opposed surface 241*d* and the opposed surface 272*a*) of the yoke upper plate (the fixed member) 241 and the movable iron core 270 conforms to the direction of the first magnetic flux M1 between the opposed surfaces (the opposed surface 241*d* and the opposed surface 272*a*) of the yoke upper plate (the fixed member) 241 and the movable iron core 270 (in FIG. 23, the downward direction).

As described above, the permanent magnet 40I of the present embodiment is arranged around the opposed surfaces (the opposed surface 241*d* and the opposed surface 272*a*) of the yoke upper plate (the fixed member) 241 and the movable iron core 270 such that the direction of the second magnetic flux M2 conforms to the direction of the first magnetic flux M1 between the opposed surfaces.

As shown in FIG. 22 and FIG. 23, the magnetic body 50 is placed on at least one of the pair of magnetized surfaces (the upper surface 41 and the lower surface 42) of the permanent magnet 40I.

In particular, the magnetic body 50 is placed on the upper surface 41 of the permanent magnet 40I.

In the present embodiment, the circular (ring-shaped) magnetic body 50 having a rectangular shape in cross section is placed on the permanent magnet 40I, as shown in FIG. 22 and FIG. 23. The magnetic body 50 is arranged on the upper side of the permanent magnet 40I such that the lower surface 51 (the surface toward the permanent magnet 40I) is in contact with the upper surface 41 of the permanent magnet 40I.

The magnetic body 50 located on the upper surface 41 of the permanent magnet 40I overlaps with the flange 272 of the movable iron core 270 (the member located toward the corresponding magnetic body 50) as viewed in the radial direction (in the direction perpendicular to the reciprocating direction of the movable iron core 270).

The magnetic body 50 may be placed only on one of the pair of magnetized surfaces (the upper surface 41 and the lower surface 42) of the permanent magnet 40I.

The magnetic body 50 may be placed on both the upper surface 41 and the lower surface 42 of the permanent magnet 40I, or may be placed only on the lower surface 42 of the permanent magnet 40I.

The present embodiment described above can also achieve the similar advantageous effects as the first embodiment.

Figure 24:
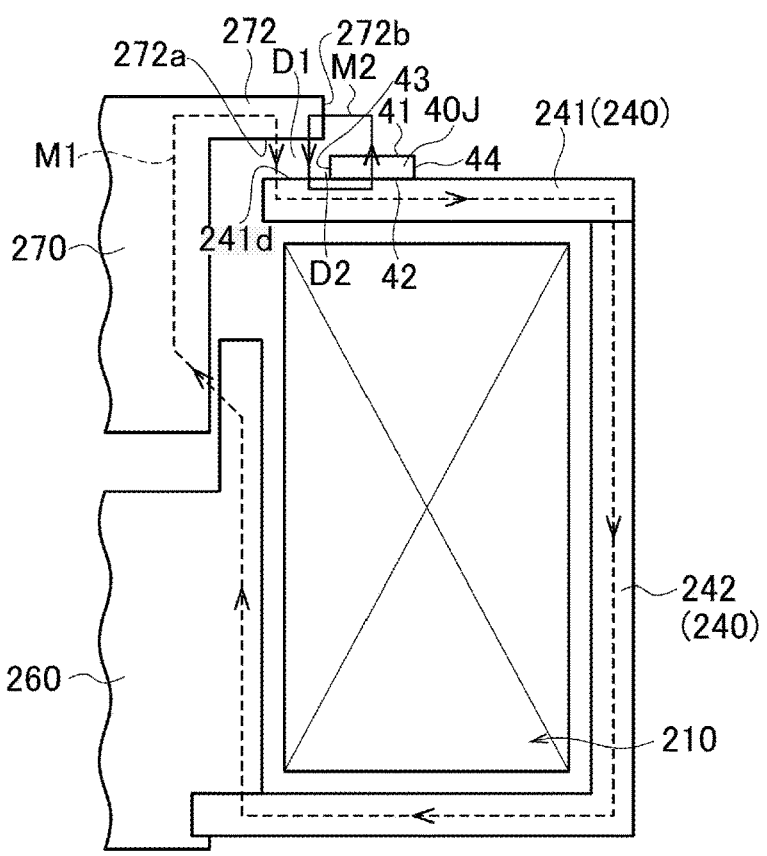
FIG. 24 is a view for schematically illustrating a flow of a magnetic flux generated in an electromagnetic relay according to a first modified example of the fourth embodiment of the present invention.
Figure 25:
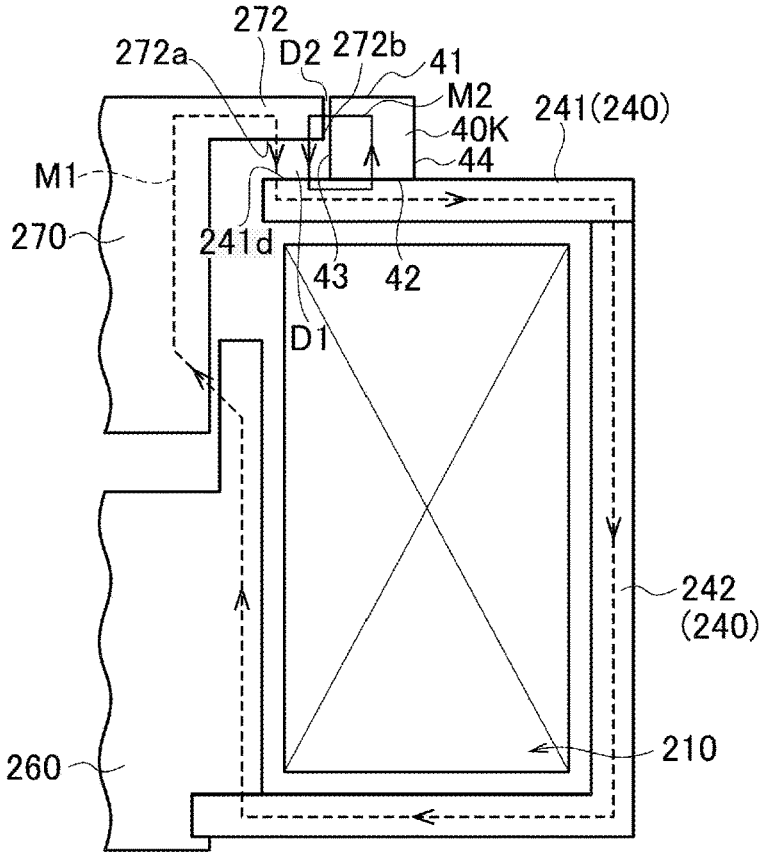
FIG. 25 is a view for schematically illustrating a flow of a magnetic flux generated in an electromagnetic relay according to a second modified example of the fourth embodiment of the present invention.
Figure 26:
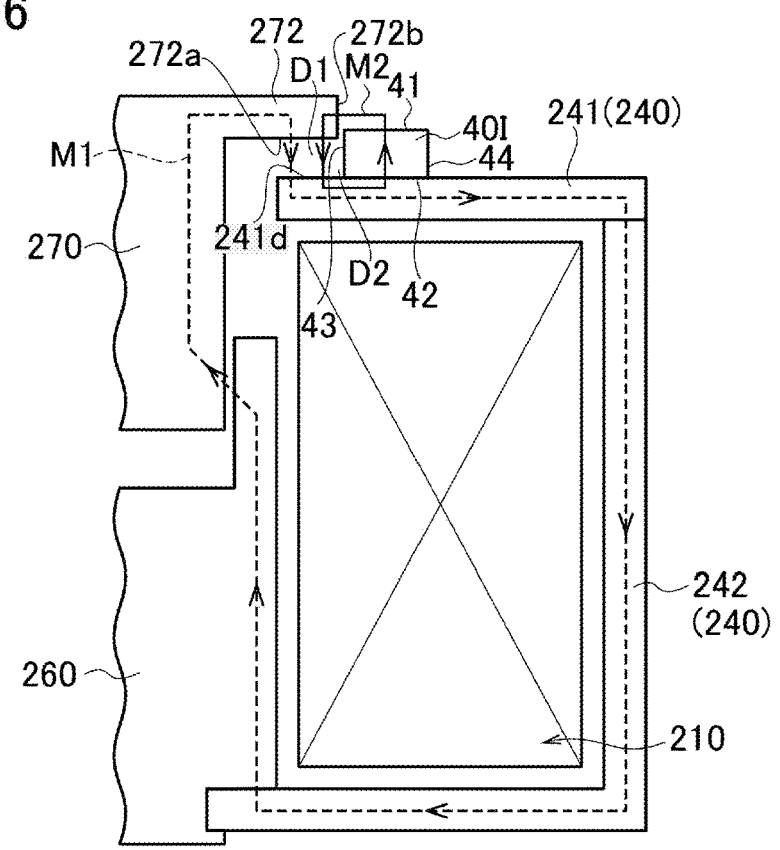
FIG. 26 is a view for schematically illustrating a flow of a magnetic flux generated in an electromagnetic relay according to a third modified example of the fourth embodiment of the present invention.

Although the present embodiment exemplified the case in which the magnetic body 50 is placed on the upper surface 41 of the permanent magnet 40I, the magnetic body 50 is not necessarily provided, as shown in FIG. 24 to FIG. 26.

FIG. 24 illustrates a permanent magnet 40J with a reduced thickness in the vertical direction (in the reciprocating direction of the movable iron core 270) placed on the upper surface 241*d* of the yoke upper plate (the fixed member) 241.

The permanent magnet 40J is also arranged on the upper surface 241*d* of the yoke upper plate 241 in the state in which the upper surface 41 serves as the N-pole and the lower surface 42 serves as the S-pole.

As shown in FIG. 24, the permanent magnet 40J is arranged such that the upper portion and the lower portion of the inner surface 43 are both opposed to the gap D1. Namely, the inner surface 43 of the permanent magnet 40J entirely faces the gap D1 in the radial direction.

This arrangement can also increase the magnetic flux (the second magnetic flux M2) generated by the permanent magnet 40J and flowing through the opposed surfaces more efficiently, so as to further improve the attractive force acting on the movable iron core 270 for moving toward the yoke upper plate (the fixed member) 241.

FIG. 25 illustrates a permanent magnet 40K with an increased thickness in the vertical direction (in the reciprocating direction of the movable iron core 270) placed on the upper surface 241*d* of the yoke upper plate (the fixed member) 241.

The permanent magnet 40K is arranged on the upper surface 241*d* of the yoke upper plate 241 in the state in which the inner surface 43 serves as the N-pole and the lower surface 42 serves as the S-pole.

The permanent magnet 40K is arranged such that the upper portion of the inner surface 43 is opposed to the outer surface 272*b* of the flange 272 as viewed in the radial direction (in the direction perpendicular to the reciprocating direction of the movable iron core 270).

This arrangement can also increase the magnetic flux (the second magnetic flux M2) generated by the permanent magnet 40K and flowing through the opposed surfaces more efficiently, so as to further improve the attractive force acting on the movable iron core 270 for moving toward the yoke upper plate (the fixed member) 241.

As shown in FIG. 26, only the permanent magnet 40I shown in FIG. 23 may be placed on the upper surface 241*d* of the yoke upper plate (the fixed member) 241.

This arrangement can also increase the magnetic flux (the second magnetic flux M2) generated by the permanent magnet 40I and flowing through the opposed surfaces more efficiently, so as to further improve the attractive force acting on the movable iron core 270 for moving toward the yoke upper plate (the fixed member) 241.

Figure 27:
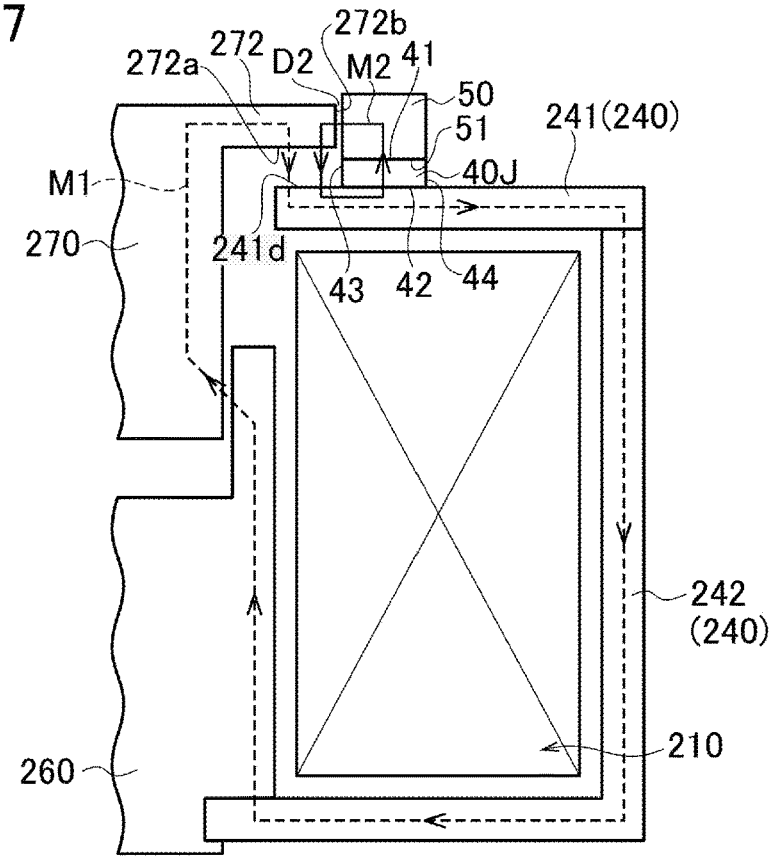
FIG. 27 is a view for schematically illustrating a flow of a magnetic flux generated in an electromagnetic relay according to a fourth modified example of the fourth embodiment of the present invention.

As shown in FIG. 27, the magnetic body 50 may be placed on the upper surface 41 of the permanent magnet 40J shown in FIG. 24 located on the upper surface 241*d* of the yoke upper plate (the fixed member) 241.

This arrangement can also increase the magnetic flux (the second magnetic flux M2) generated by the permanent magnet 40J and flowing through the opposed surfaces more efficiently, so as to further improve the attractive force acting on the movable iron core 270 for moving toward the yoke upper plate (the fixed member) 241.

When the permanent magnet 40K shown in FIG. 25 is arranged on the upper surface 241*d* of the yoke upper plate (the fixed member) 241, the magnetic body 50 may be placed in the space D2 (between the inner surface 43 of the permanent magnet 40K and the outer surface 272*b* of the flange 272).

The present embodiment may use the shape and the arrangement position of the respective permanent magnets shown in FIG. 9 to FIG. 14.

While the present invention has been described above by reference to the preferred embodiments, the present invention is not intended to be limited to the descriptions thereof, and various modifications will be apparent to those skilled in the art.

For example, although the embodiments exemplified the case in which the yoke 370 includes the upper yoke 371 and the lower yoke 372, the yoke 370 may include one of the upper yoke 371 and the lower yoke 372, or the electromagnetic relay may exclude the yoke 370.

Although the embodiments exemplified the case in which the pressure spring 340 is inserted into the insertion hole 372*a* of the lower yoke 372, the pressure spring 340 may be in contact with the lower yoke 372.

The coil bobbin 220 may have various kinds of shapes, and the position of the coil bobbin 220 may be varied as appropriate.

Although the embodiments illustrated the integrated circular (ring-shaped) permanent magnet, a permanent magnet divided into several parts may be used and assembled into a circular shape (a ring-like shape) when arranged adjacent to the opposed surfaces.

For example, a plurality of permanent magnets each formed into an arc of a ring (arc-like permanent magnets each having a central angle of less than 360°: doughnut-shaped divided permanent magnets) may be used and assembled into a circular shape (a ring-like shape) when arranged adjacent to the opposed surfaces.

Namely, pieces of permanent magnets in which the sum of the central angles is 360° are assembled without gap in the circumferential direction, so as to be formed into a circular shape (a ring-like shape) when arranged adjacent to the opposed surfaces.

For example, two pieces of permanent magnets each having a central angle of 180° may be used, or two pieces of permanent magnets in which one has a central angle of 300° and the other has a central angle of 60° may be used.

A permanent magnet formed into an arc of a circle may only be arranged adjacent to the opposed surfaces.

A plurality of permanent magnets may be assembled with at least a single gap provided in the circumferential direction and arranged adjacent to the opposed surfaces. For example, a plurality of permanent magnets may be arranged radially, or may be arranged into a C-shape adjacent to the opposed surfaces.

Alternatively, at least one substantially bar-shaped permanent magnet (a bar magnet: a permanent magnet having a substantially rectangular cuboid) or one substantially U-shaped permanent magnet (a U-shaped magnet: a permanent magnet obtained such that a bar magnet is bent into a U-shape) may be used and arranged adjacent to the opposed surfaces.

The movable contact, the fixed terminals, and the other specifications (such as the shape, the size, and the layout) may also be varied as appropriate.

What is claimed is:

1. An electromagnetic device comprising:

a coil configured to generate a first magnetic flux when a current is applied thereto;

a fixed iron core through which the first magnetic flux flows;

a movable iron core configured to reciprocate to separate from the fixed iron core by a predetermined gap when the current applied to the coil is stopped and move to the fixed iron core by an attractive force when the current is applied to the coil;

a permanent magnet configured to generate a second magnetic flux; and a magnetic body which is placed on a surface of the permanent magnet, wherein the movable iron core is configured to move relative to the permanent magnet, the gap is formed between opposed surfaces of the fixed iron core and the movable iron core in first direction parallel to a direction that the movable iron core reciprocates, the permanent magnet is arranged so that the permanent magnet is opposed to the gap in second direction perpendicular to the first direction and separated from the fixed iron core and the movable iron core with a space interposed therebetween, the surface of the permanent magnet is perpendicular to the first direction, and a direction of the second magnetic flux conforms to a direction of the first magnetic flux between opposed surfaces of the fixed iron core and the movable iron core.

2. The electromagnetic device according to claim 1, wherein the surface of the permanent magnet is a magnetized surface.

3. The electromagnetic device according to claim 1, wherein the permanent magnet is formed into a ring-like shape to surround the gap.

4. The electromagnetic device according to claim 1, wherein the permanent magnet is arranged to overlap with at least one of the fixed iron core and the movable iron core as viewed in the second direction.

5. The electromagnetic device according to claim 1, wherein the magnetic body is arranged to overlap with the fixed iron core or the movable iron core located closer to the magnetic body as viewed in the second direction.

6. An electromagnetic relay equipped with the electromagnetic device according to claim 1.

7. An electromagnetic device comprising:

a coil configured to generate a first magnetic flux when a current is applied thereto;

a yoke, arranged around the coil, through which the first magnetic flux flows;

a movable iron core configured to reciprocate to separate from the yoke by a predetermined gap when the current applied to the coil is stopped and move to the yoke by an attractive force when the current is applied to the coil;

a permanent magnet configured to generate a second magnetic flux; and a magnetic body which is placed on a surface of the permanent magnet, wherein the movable iron core is configured to move relative to the permanent magnet, the gap is formed between opposed surfaces of the yoke and the movable iron core in first direction parallel to a direction that the movable iron core reciprocates, the permanent magnet is arranged so that the permanent magnet is opposed to the gap in second direction perpendicular to the first direction and separated from the yoke and the movable iron core with a space interposed therebetween, the surface of the permanent magnet is perpendicular to the first direction, and a direction of the second magnetic flux conforms to a direction of the first magnetic flux between opposed surfaces of the yoke and the movable iron core.

8. The electromagnetic device according to claim 7, wherein the surface of the permanent magnet is a magnetized surface.

9. The electromagnetic device according to claim 7, wherein the permanent magnet is formed into a ring-like shape to surround the gap.

10. The electromagnetic device according to claim 7, wherein the permanent magnet is arranged to overlap with the movable iron core as viewed in the second direction.

11. The electromagnetic device according to claim 7, wherein the surface of the permanent magnet is parallel to an opposed surface to the yoke.

12. The electromagnetic device according to claim 7, wherein the yoke extends along the second direction.

13. An electromagnetic relay equipped with the electromagnetic device according to claim 7.

* * * * *